US006910350B2

(12) United States Patent
Brigham et al.

(10) Patent No.: US 6,910,350 B2
(45) Date of Patent: Jun. 28, 2005

(54) NITROGEN GENERATOR

(75) Inventors: William D. Brigham, Huntington Beach, CA (US); Brian R. Wildey, Coto de Daza, CA (US); Robert A. Zarate, Murrieta, CA (US)

(73) Assignee: Pacific Consolidated Industries, LLC, Riverside, CA (US)

( * ) Notice: Subject to any disclaimer, the term of this patent is extended or adjusted under 35 U.S.C. 154(b) by 0 days.

(21) Appl. No.: 10/637,399

(22) Filed: Aug. 8, 2003

(65) Prior Publication Data

US 2004/0050095 A1 Mar. 18, 2004

Related U.S. Application Data

(60) Provisional application No. 60/402,878, filed on Aug. 8, 2002.

(51) Int. Cl.[7] ..... F25J 3/00; F25J 5/00; B01D 3/00; C02F 1/18

(52) U.S. Cl. ..... 62/643; 62/911; 202/83

(58) Field of Search ..... 62/643, 911; 202/83

(56) References Cited

U.S. PATENT DOCUMENTS

| | | | | | |
|---|---|---|---|---|---|
| 4,899,827 | A | * | 2/1990 | Poole | 169/69 |
| 5,121,600 | A | * | 6/1992 | Sanders et al. | 60/39.464 |
| 5,349,827 | A | * | 9/1994 | Bracque et al. | 62/298 |
| 5,388,650 | A | | 2/1995 | Michael | |
| 5,461,871 | A | * | 10/1995 | Bracque et al. | 62/643 |
| 5,896,755 | A | * | 4/1999 | Wong et al. | 62/643 |
| 6,041,873 | A | | 3/2000 | Michael | |
| 6,128,921 | A | * | 10/2000 | Guillard et al. | 62/643 |
| 6,272,883 | B2 | * | 8/2001 | Bruder et al. | 62/643 |
| 6,443,245 | B2 | | 9/2002 | Michael | |
| 2003/0089126 | A1 | * | 5/2003 | Stringer et al. | 62/643 |

OTHER PUBLICATIONS

"PanCanadian tries coiled–tubing completion. (PanCanadian Petroleum Ltd. executes portion of directional drilling project with coiled tubing)", Improved Recovery Week, v2, n7, p1 (2), Feb. 22, 1993.

Gunn, John, "Damage control: underbalanced drilling is moving to the top of the toolbox. (oil and gas well drilling)", Oilweek, v45, n12, p 20 (1), Mar. 21, 1994.

"*Prism* Alpha Membrane Seperators—For Low–Cost On–Site Nitrogen." Permea Inc., A Monsanto Company, 1987, pp. 1–8.

Dr. sc. Techn. T. Johannessen "Presentation of a 6000 $Nm^3/h$ Nitrogen System based on Membrane Separation of Air", Swiss Chem, 9 (1987).

"Nitrogen Generating Systems" from Zwick Energy Research.

"*Prism* membrane nitrogen systems . . . for safe and economic offshore operations." Permea Maritime.

(Continued)

*Primary Examiner*—William C. Doerrler
(74) *Attorney, Agent, or Firm*—Knobbe, Martens, Olson & Bear, LLP

(57) ABSTRACT

A portable cryogenic nitrogen generator consists of an air preparation unit and a cryogenic distillation unit mounted inside separate standard-sized ISO containers that can be easily shipped to a drilling site and efficiently and quickly assembled into an operative state. The containers can be connected together at anchor points on the housings of both containers, making the nitrogen generator assembly more stable. The air preparation unit includes an absorption device and optionally includes one or a plurality of air compressor units. The cryogenic distillation unit includes a distillation column and associated heat exchangers. The air preparation and cryogenic distillation units connect through apertures in their respective containers and operate while being mounted in the containers.

17 Claims, 24 Drawing Sheets

OTHER PUBLICATIONS

P.D. Allan, Meridian Oil, Inc. "Nitrogen Drilling System for Gas Drilling Applications," Society of Petroleum Engineers, Inc. 59$^{th}$ Annual Technical Conference and Exhibition held in New Orleans, LA, U.S.A. Sep. 25–28, 1994, pp. 1–5.

Thistle, Bruse and Falk, Kelly: "Horizontal Drilling of a Low Pressure Fractured Shale Reservoir with Crude Oil and Nitrogen" from CADE/CAODC Spring Drilling Conference, Apr. 14, 15, 16, 1993, Calgary, Alberta, Canada. Paper No. 93–1103, 18 pages.

"Petroleum Products" from Stewart & Stevenson Annual Report 1991. pp. 16–17.

"Feasibility Study: Ekofist Nitrogen Production Vessel", Nov. 1985.

"Underbalanced Well Operations" from Nowsco Engineering Technology Update.

"Under–Balanced Drilling Options" by Nowsco Well Service Ltd.

"High Tech Nitrogen Pumper Is Developed" The American Oil & Gas Reporter, Jul. 1991, pp. 58–59.

Laboratory Services for Advanced Catalyst Systems, LLC, www.advancedcatalyst.com, site visited Oct. 14, 2002.

"BOC Gases source of information of the Heat Treat industry" from CATweb, www.b2.boc.com/catweb, site visited Nov. 4, 2002.

Product information on 40'×9'6" Dry Freight ISO Containers, www.seabox.com, site visited Aug. 7, 2002.

Sea Box, Inc. Product Catalog SB–1 "Family of Standard Military ISO Cargo Containers".

Sea Box, Inc. Product Catalog SB–2 "Rare/Special Military ISO Containers, Chassis and Generator Sets".

Sea Box, Inc. Product Catalog SB–5 "Family of Intermodal Internal ISO Container Designs".

Sea Box, Inc. Product Catalog "Integrated ISO Container Systems".

PCT International Search Report dated Jul. 6, 2004 for Int'l Application No. PCT/US03/25802, filed Aug. 8, 2003.

* cited by examiner

| | |
|---|---|
| FIG. 1A | FIG. 1B |
| FIG. 1C | FIG. 1D |
| FIG. 1E | FIG. 1F |

FIG. 1

| | |
|---|---|
| FIG. 2A | FIG. 2B |
| FIG. 2C | FIG. 2D |
| FIG. 2E | FIG. 2F |

FIG. 2

| | |
|---|---|
| FIG. 3A | FIG. 3B |
| FIG. 3C | FIG. 3D |
| FIG. 3E | FIG. 3F |

FIG. 3

FIG. 5
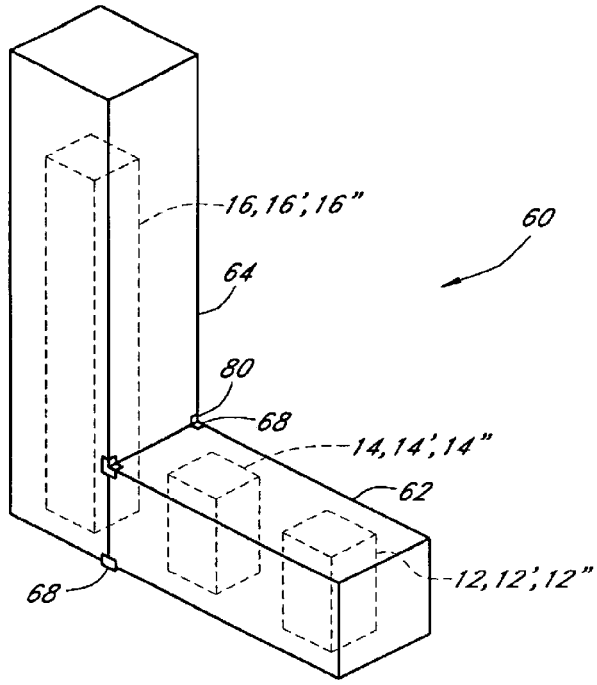
FIG. 6
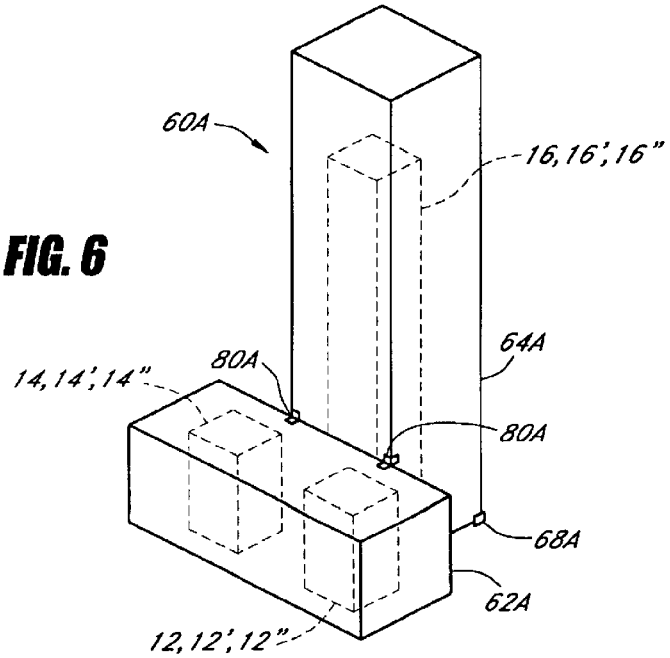
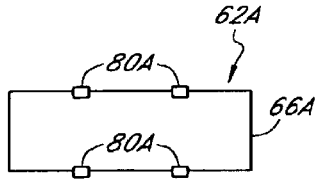
FIG. 6A

NITROGEN GENERATOR

RELATED CASES

This application is based on and claims priority to U.S. Provisional Patent Application Ser. No. 60/402,878, filed Aug. 8, 2002, the entire contents of which is hereby incorporated by reference.

BACKGROUND OF THE INVENTION

1. Field of the Invention

The present invention is directed to nitrogen generators, and in particular, portable cryogenic nitrogen generators.

2. Description of the Related Art

Inert gases are widely used in many industrial processes. For example, nitrogen gas is commonly used in conjunction with operation of a drilling rig for oil, gas, or geothermal wells, as well as for post drilling operations. In particular, nitrogen is injected into the down-hole region during a drilling operation, to remove drill cuttings.

In the art of well drilling, tubular casings are typically inserted into the wells so as to secure the perimeter of the wellbore. In some wells, multiple casings are secured at the surface of the well to lower down-hole locations. Other types of casings, called liners, are sometimes used to extend from the lower-most casing into the lower-most portion of the wellbore. Drilling fluids, such as drilling mud, are often used when large flows of water are present in the well. The drilling mud is circulated down the drill string, through the drill bit, and up the annular region between the drill string and the wellbore or casing. Gas, such as Nitrogen gas, may be injected into the down-hole region to provide faster drilling when substantial amounts of water are not present in the well.

In the past, air has been used as the principal down-hole drilling fluid for lower water content drilling. The air can be combined with a surfactant, foaming agent, water, and/or mud for different applications. The primary advantages of straight air drilling are greatly increased penetration rates, greater bit footage, and fewer down-hole drilling problems.

However, drilling with air does raise a number of disadvantages. For example, injection of high-pressure air into a down-hole during a drilling operation increases corrosion rates and raises the risk of explosions or fire due to the presence of high levels of oxygen in the pressurized air. In order to reduce the risk of explosions or fire, it has been known to reduce the temperature of the injected air, or to replace the air with an inert gas, such as Nitrogen.

One option for supplying nitrogen gas to the down-hole region of a well during a drilling operation is to ship containerized nitrogen to the drilling site and pump the nitrogen gas into the well at a pressure from about 200 psig to 10,000 psig. However, the shipment of containerized nitrogen to a drilling site, which may be in a remote location, can be expensive. Thus, it is more desirable to generate nitrogen gas at the site of the drilling operation.

One option for producing nitrogen gas at a drilling site is disclosed in U.S. Pat. No. 6,041,873 issued to Michael, the entire contents of which is hereby expressly incorporated by reference. The Michael patent discloses a portable unit that produces nitrogen gas through non-cryogenic systems including membrane separation units.

SUMMARY OF THE INVENTION

One drawback of non-cryogenic devices is that efficiency drops off rapidly as purity increases. For example, it has been found that portable membrane separation units can provide 95% pure nitrogen gas at a flow rate sufficient for drilling operations. However, these units are not practical for generating an appropriate nitrogen flow at purities of above 95%, and in particular, purities above 99.0%.

One aspect of the present invention includes the realization that cryogenic nitrogen generators can be made sufficiently portable to provide practicable sources of higher purity nitrogen gas for drilling operations.

Another aspect of the present invention includes the realization that standard sized containers can be used to provide a protective housing during transportation and operation of the cryogenic nitrogen generator. By using standard size containers to form a housing for a cryogenic nitrogen generator, such as a cryogenic distillation and associated heat exchanger unit, the device can be shipped to a drilling site and efficiently and quickly assembled into an operative state. For example, a cryogenic nitrogen generator can include an air preparation unit and a cryogenic distillation and associated heat exchanger unit. The air preparation unit typically will include an absorption device, such as a Pressure Swing Absorption (PSA) or a Temperature Swing Absorption (TSA) unit. Optionally, the air preparation unit can also include one or a plurality of air compressor units. The air preparation unit can be configured to fit within a standard ISO container resting horizontally. However, a cryogenic distillation unit is quite tall. For example, typical cryogenic distillation units, also known as "cold boxes," can be as tall as 30 feet or more to produce Nitrogen gas of better than 99% purity. Thus, the distillation unit can be separately housed in a standard ISO container. With these units separately housed as such, they can be transported to and through virtually any country in the world using standard sized trucks or via ocean-going ships. Additionally, once delivered to a drilling site, the separate components can be connected and operated while they remain in the separate containers.

A further advantage in using ISO containers is that such containers include standard anchoring points which can be connected together. For example, anchoring points of each container can be connected together so as to provide further stability for plumbing connections between the containers and also to provide further stability to the container housing the distillation unit. For example, because the distillation unit is tall, connection to another container, and in particular another ISO container, provides further stability to the total system.

Typical cryogenic air separation plants are designed to remove normal levels of carbon dioxide, hydrocarbons, sulfur containing compounds, and other acid gases in ambient feed air. However, ambient air contaminate levels at oil or gas exploration drilling and recovery sites can be higher than normal levels, making it necessary to use additional precautions to ensure safe air separation plant operation. Accordingly, in one embodiment, the air preparation unit also includes a catalytic converter to remove hydrocarbons from an ambient air stream, preferably before the air stream enters the absorption device.

BRIEF DESCRIPTION OF THE DRAWINGS

FIG. 5 is a front, top, and left side perspective view of the housing unit illustrated in FIG. 4, with components of the gas separation units illustrated in FIGS. 1 and 2 shown in phantom;

FIG. 6 is a front, top, and left side perspective view of a modification of the housing assembly illustrated in FIG. 5;

FIG. 6A is a rear elevational view of the horizontal portion of the housing assembly shown in FIG. 6.

DETAILED DESCRIPTION OF THE PREFERRED EMBODIMENT

Figure 1A:
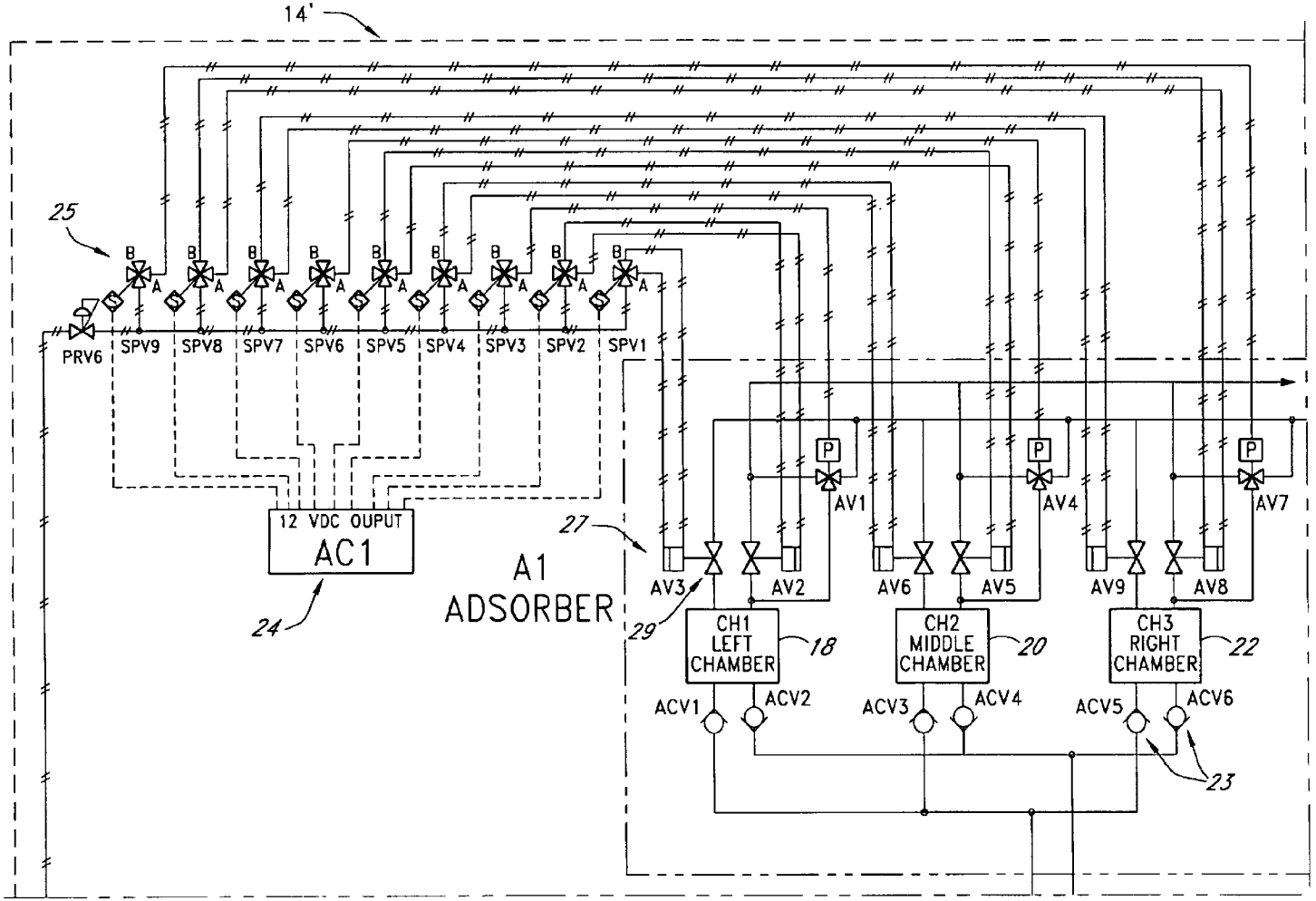
FIG. 1 is a schematic illustration of a gas separation unit constructed in accordance with one aspect of the present invention.
Figure 1B:
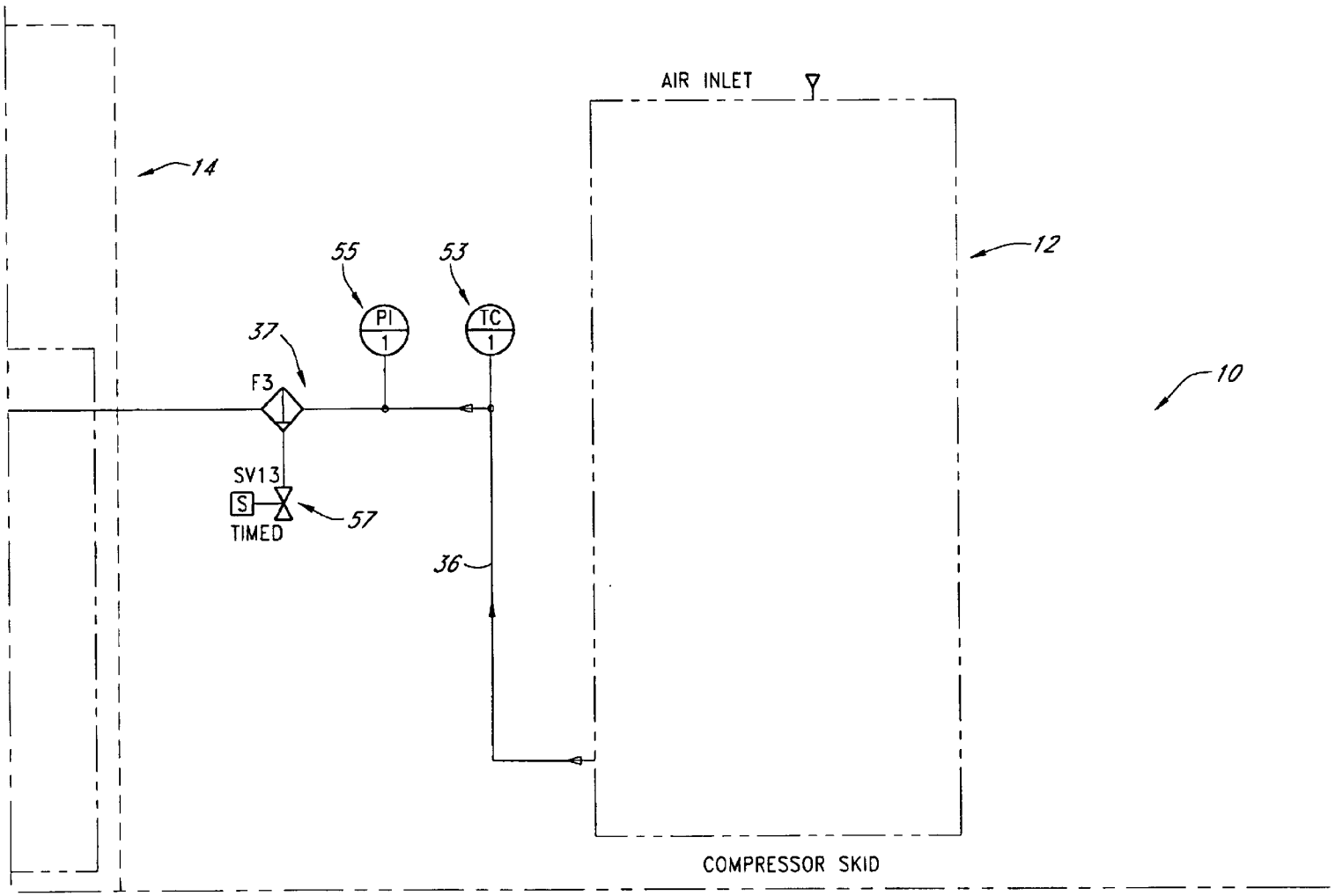
Figure 1C:
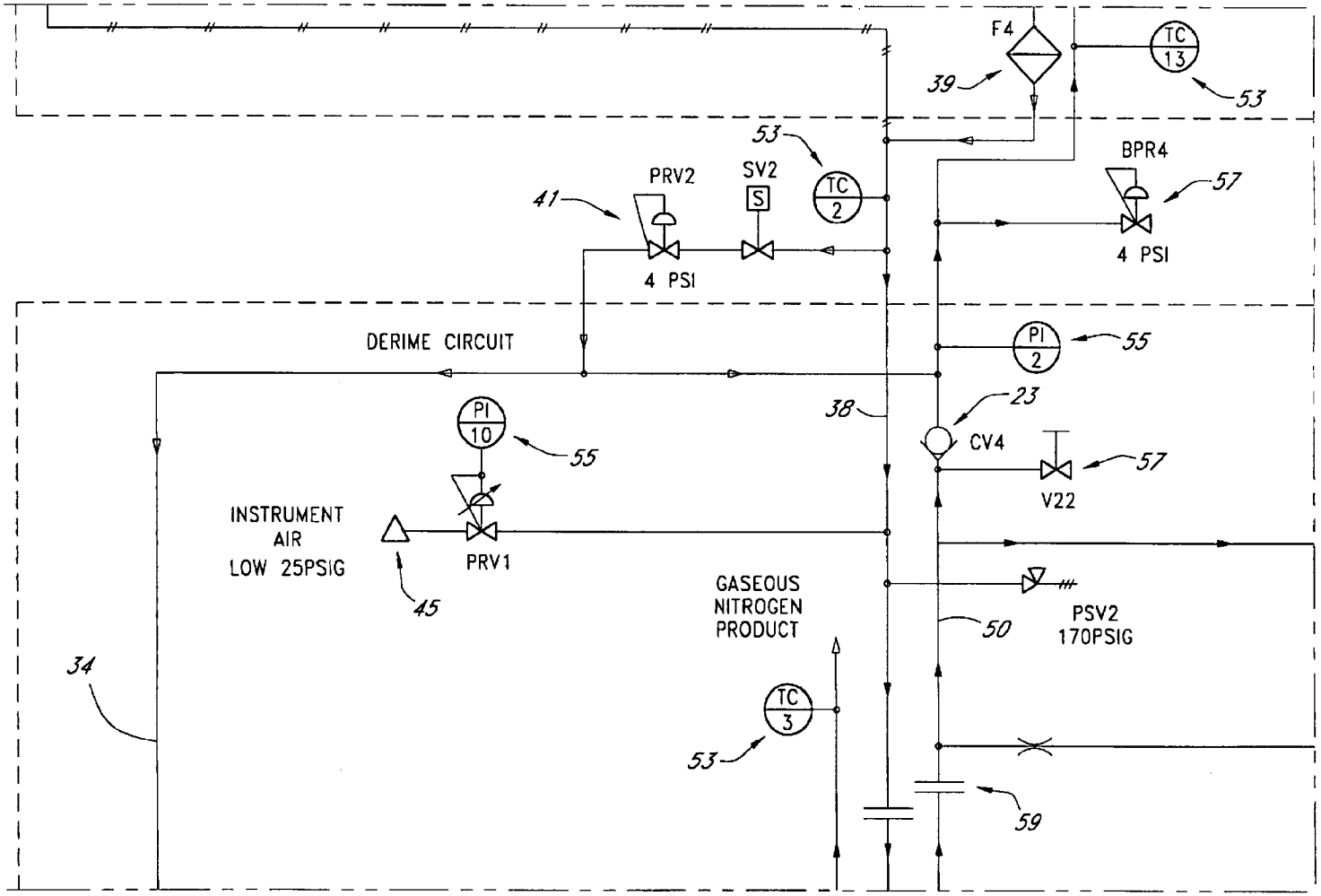
Figure 1D:
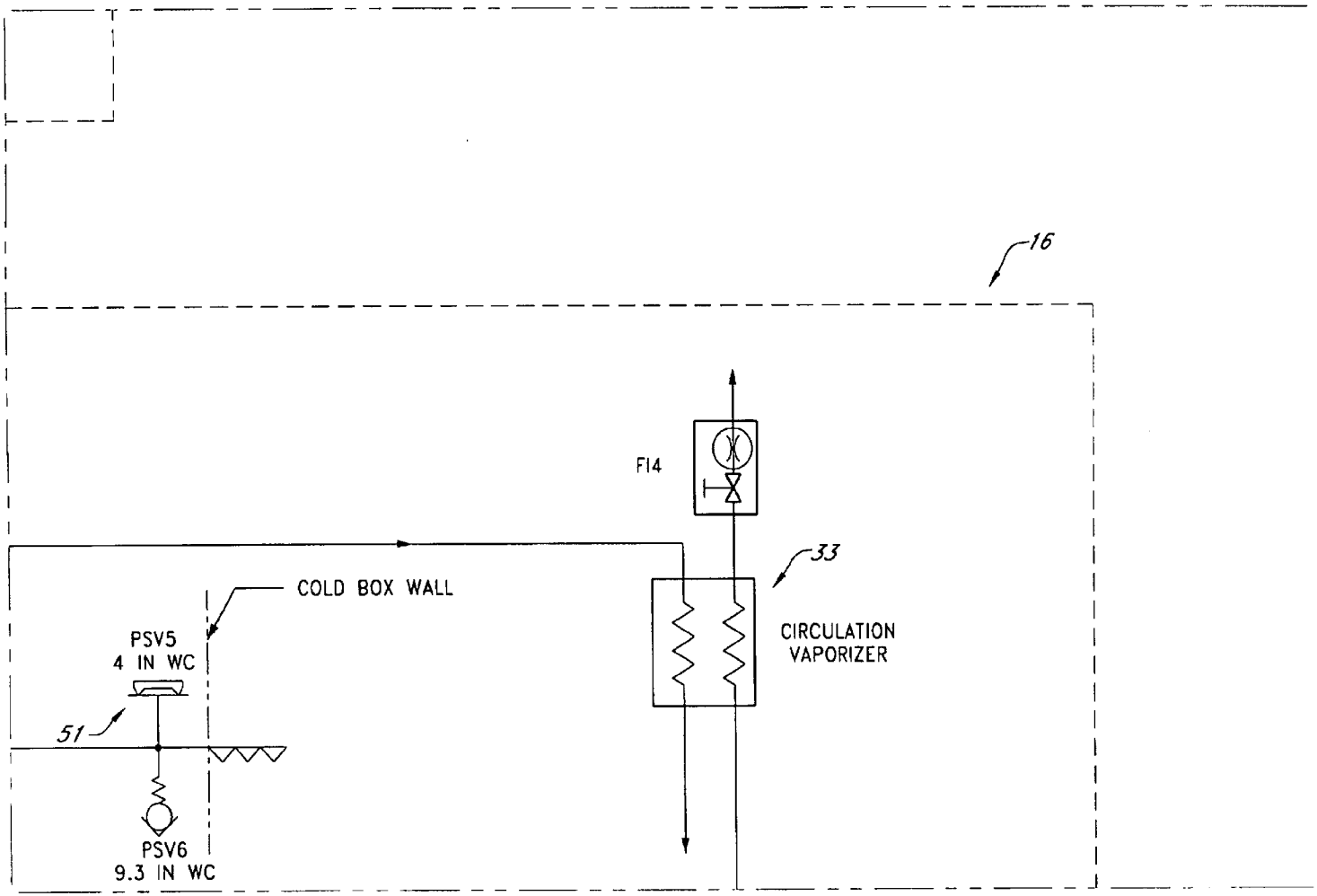
Figure 1E:
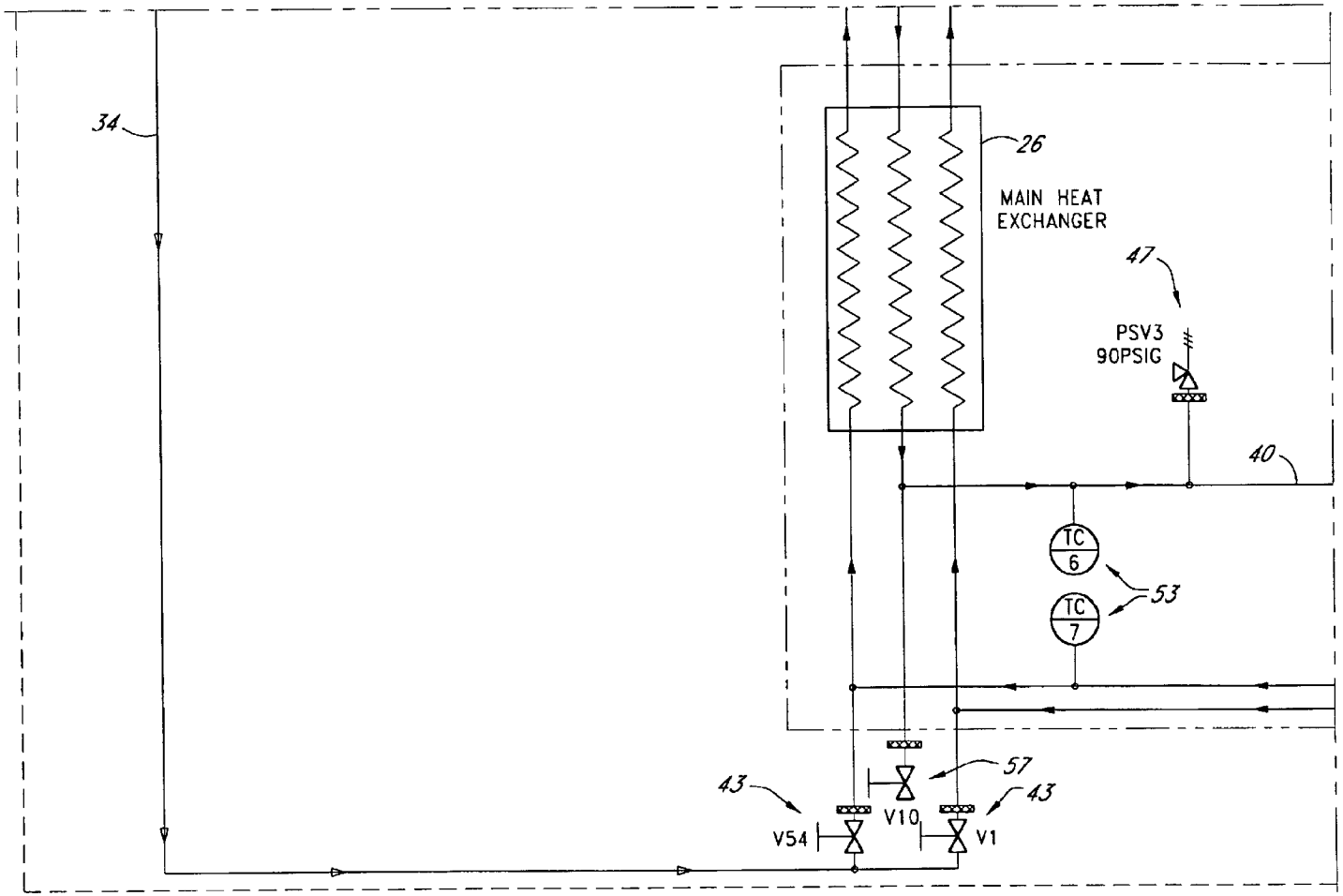
Figure 1F:
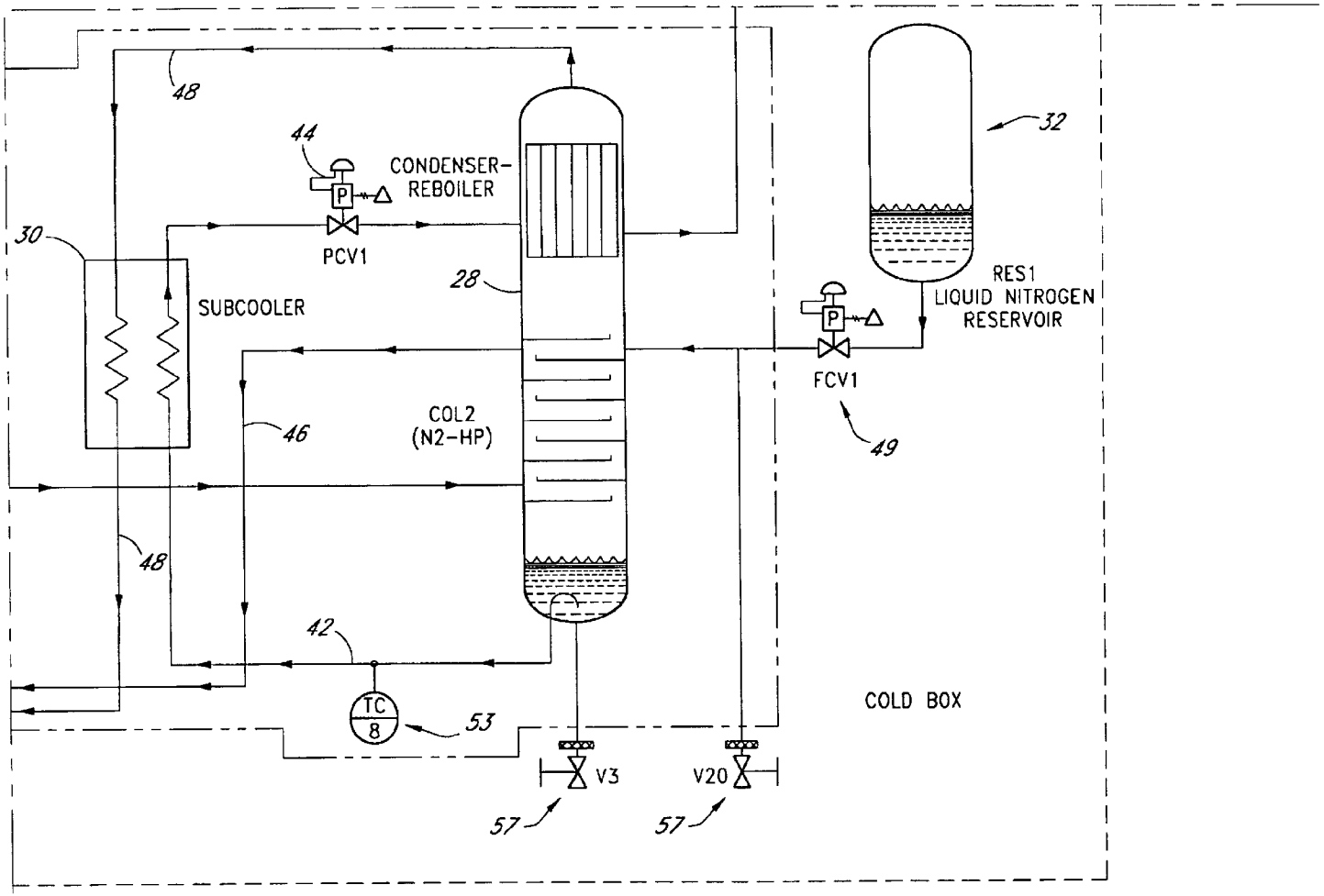
Figure 2A:
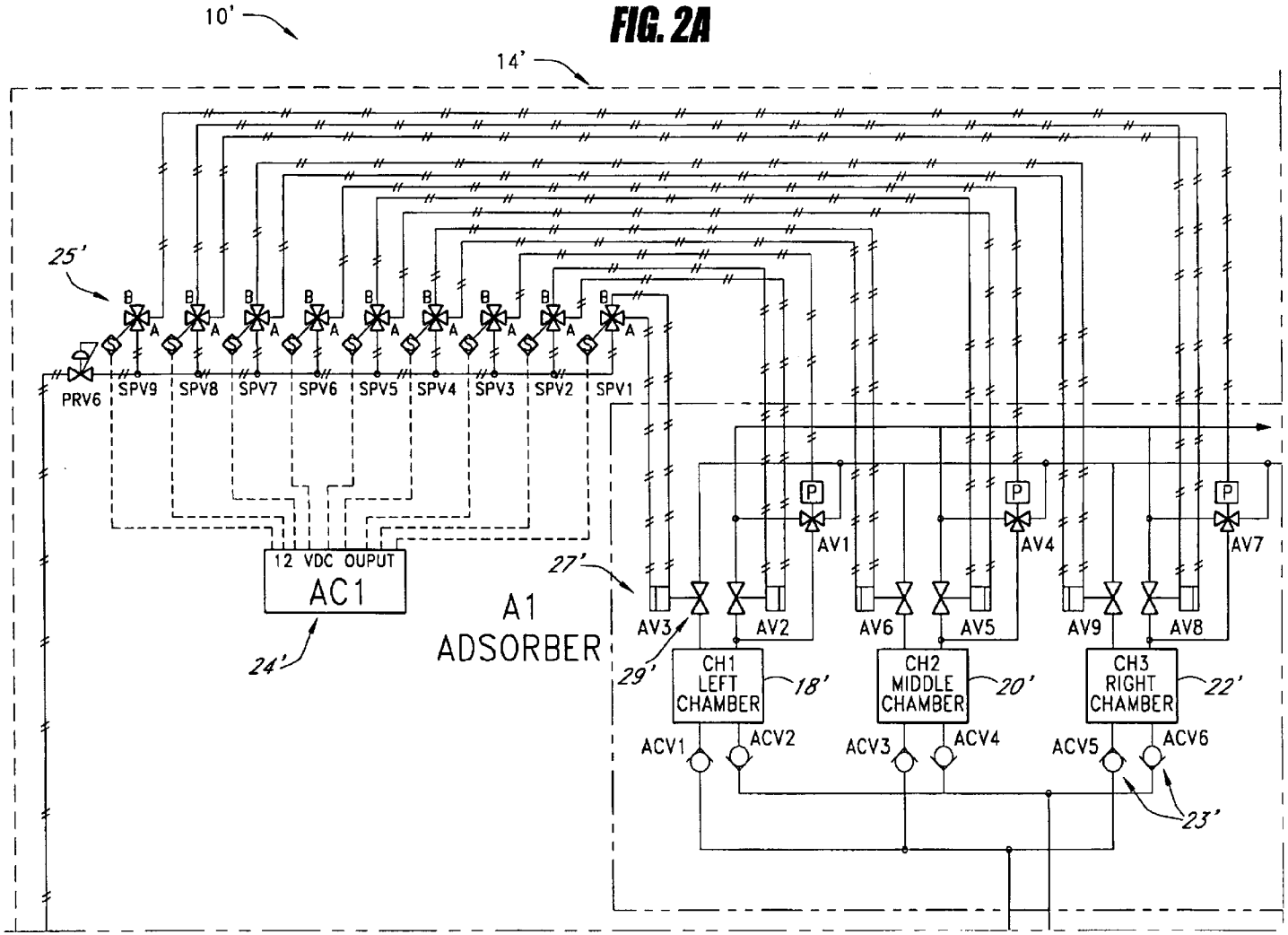
FIG. 2 is a schematic illustration of a modification of the gas separation unit illustrated in FIG. 1.
Figure 2B:
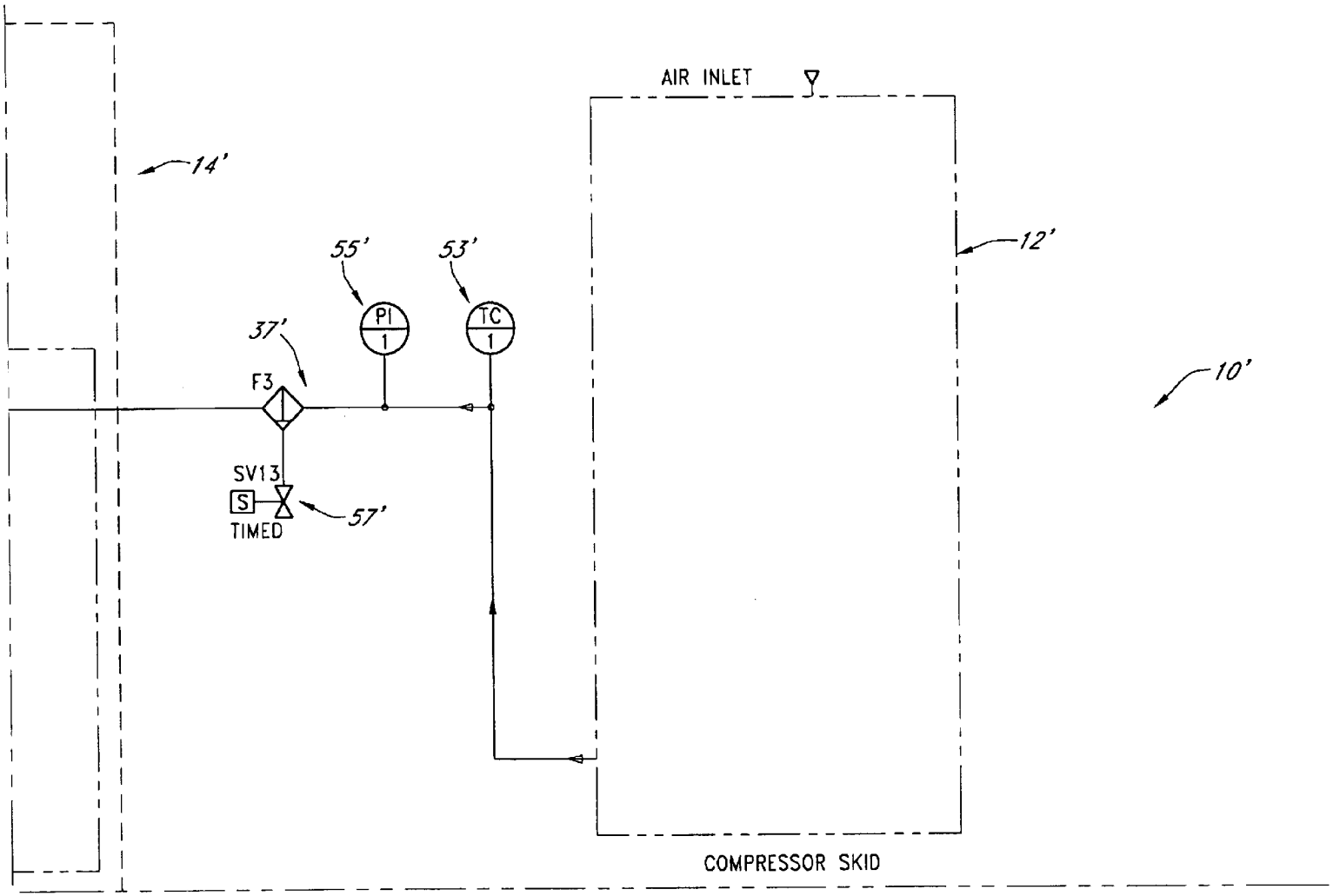
Figure 2C:
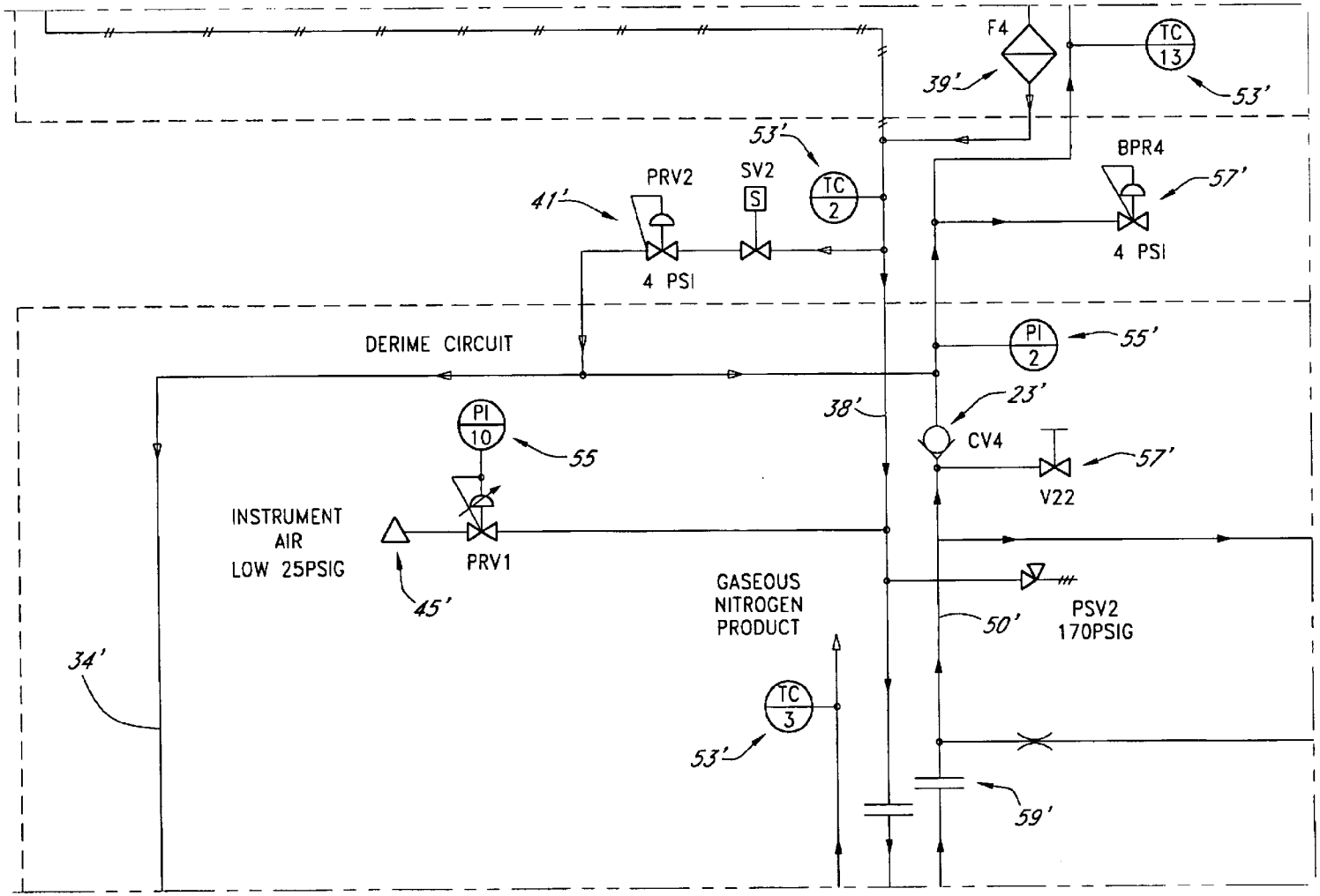
Figure 2D:
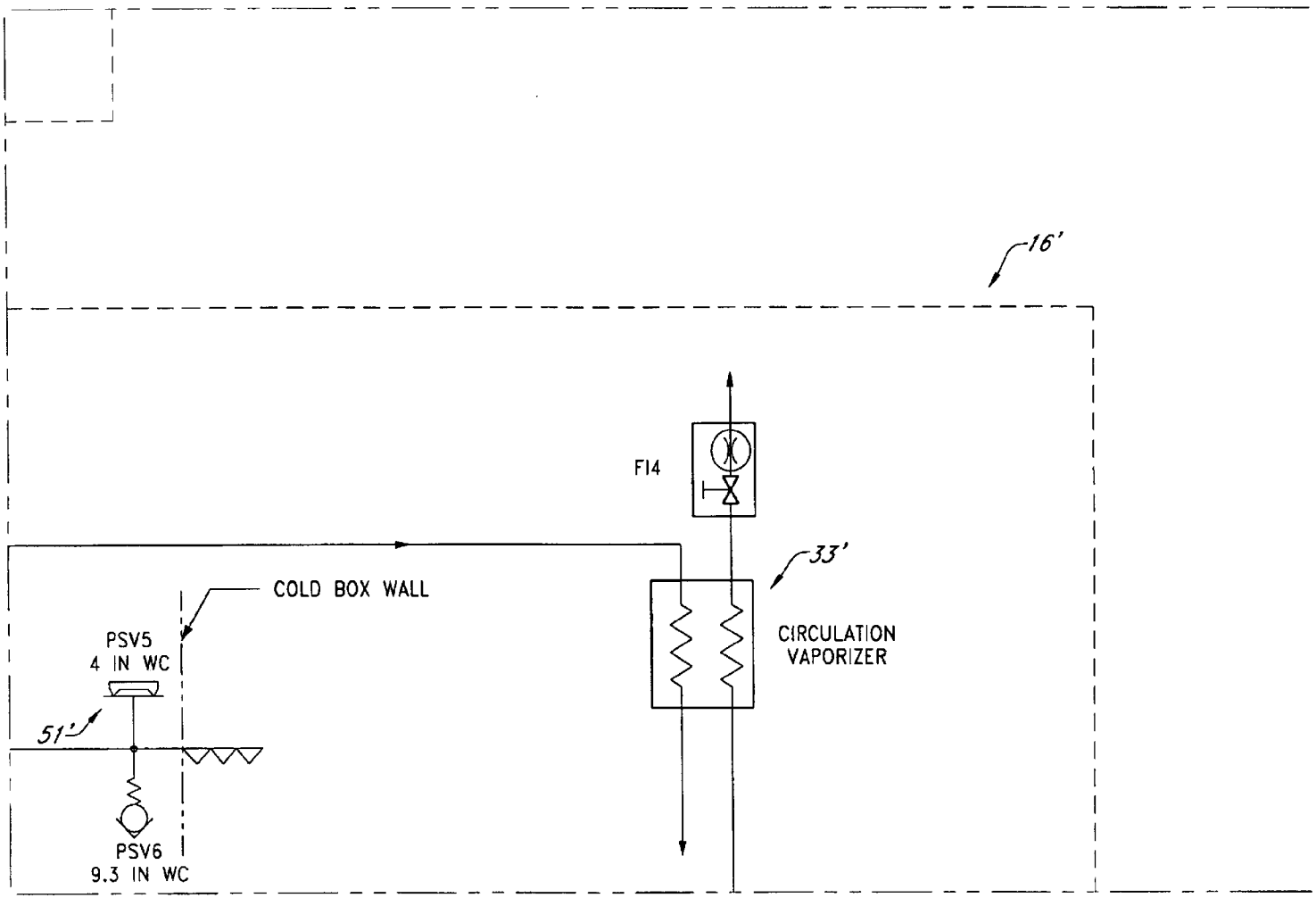
Figure 2E:
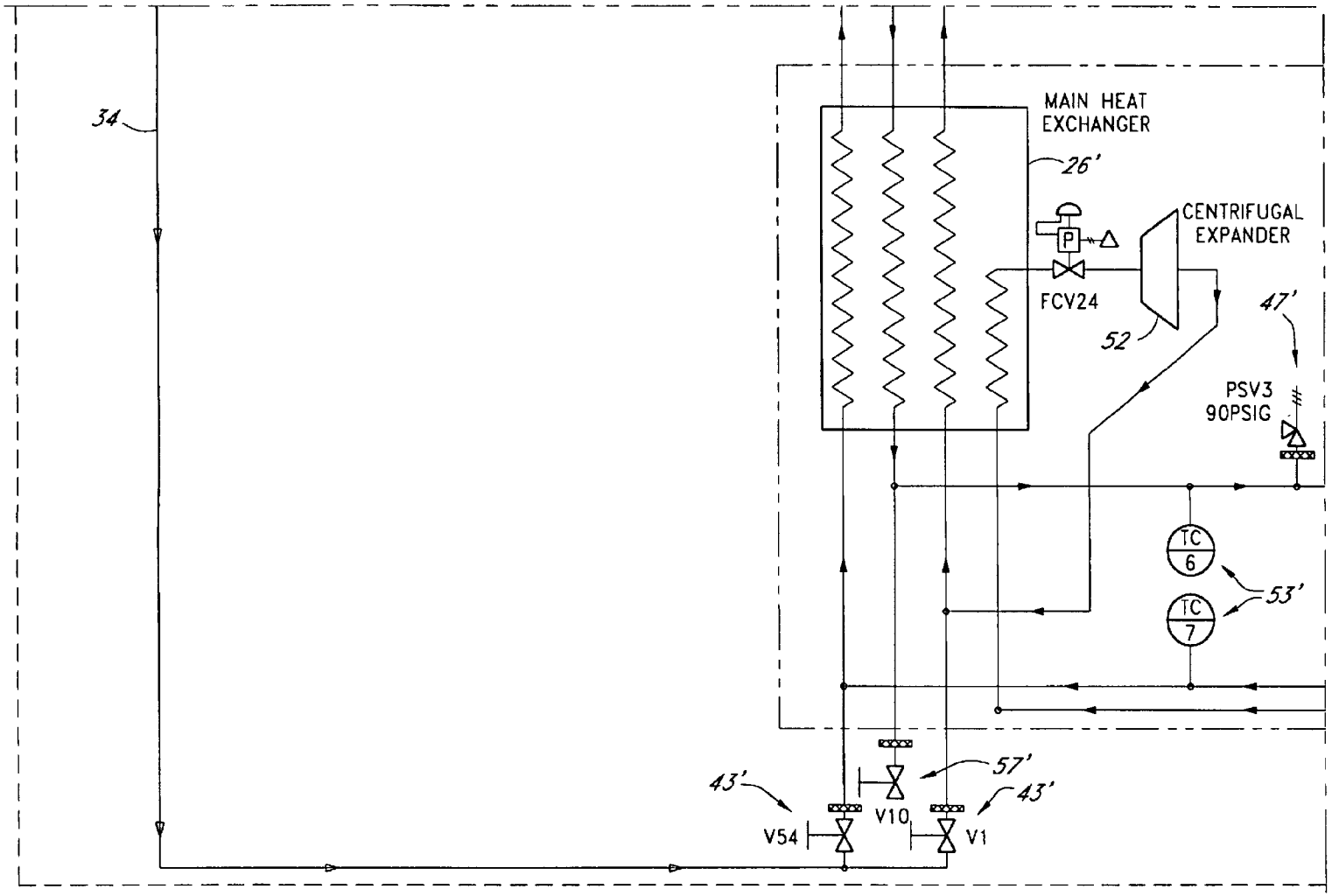
Figure 2F:
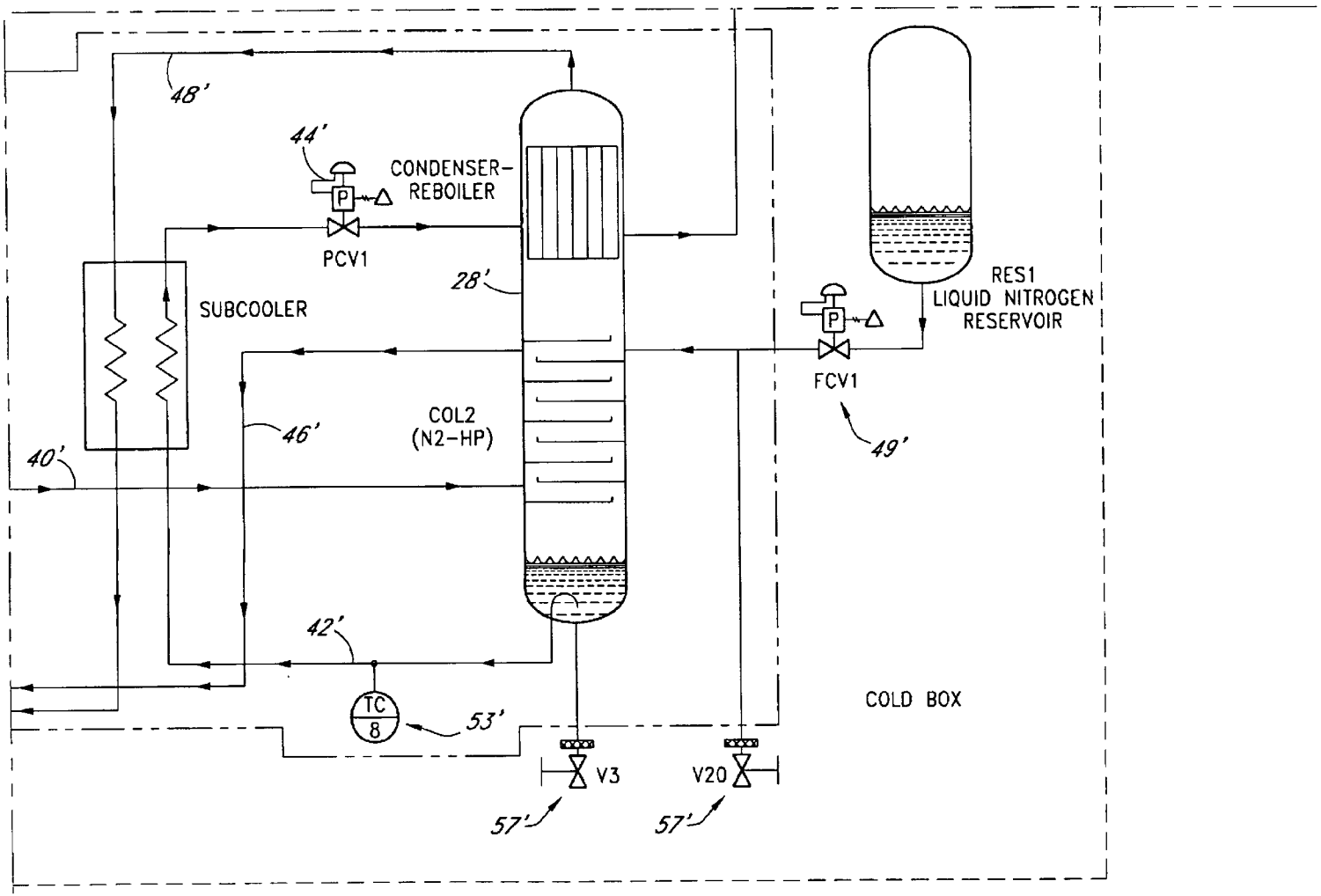
Figure 3A:
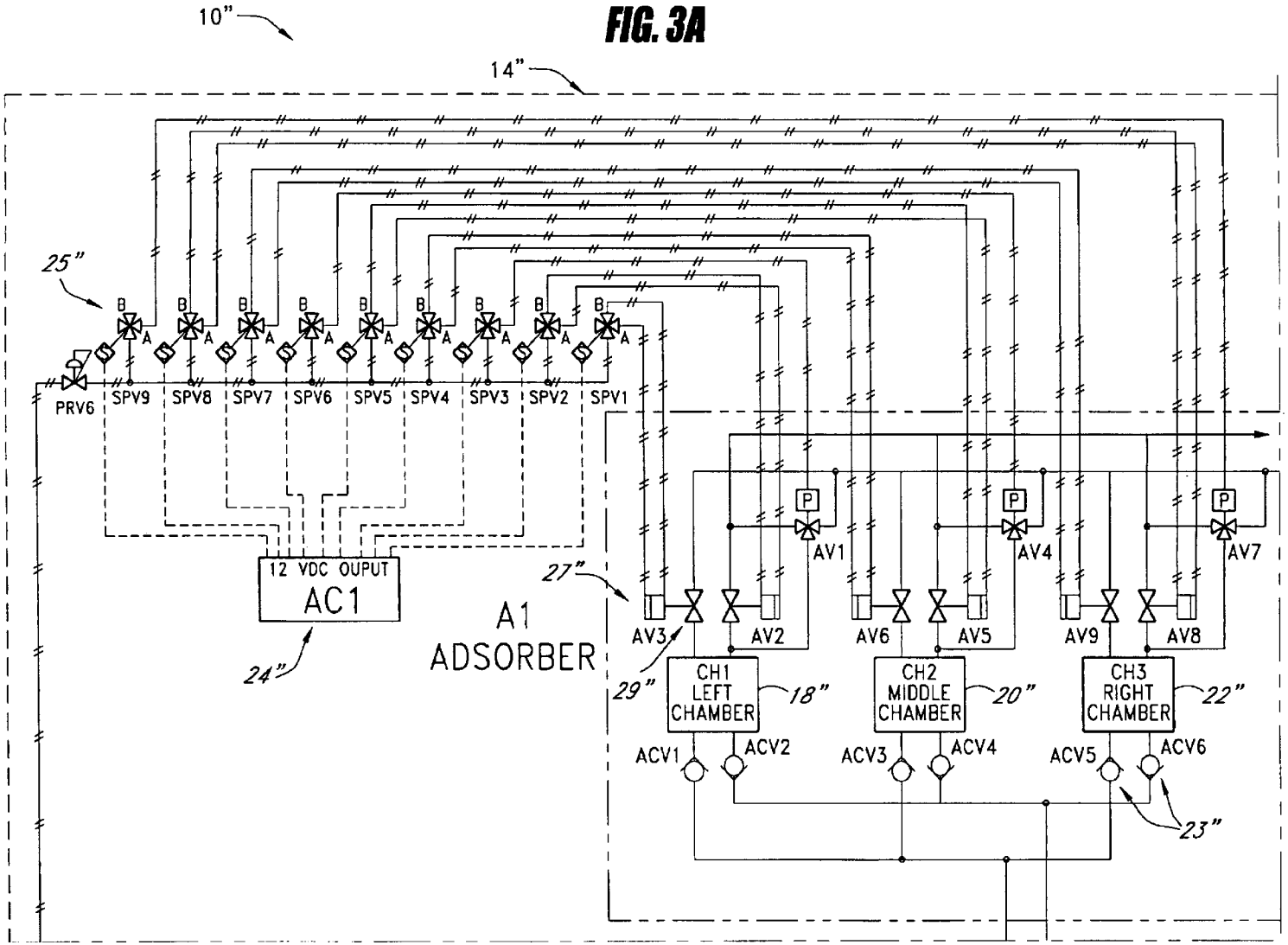
FIG. 3 is a schematic illustration of the gas separation unit illustrated in FIG. 1 containing a catalytic reactor system.
Figure 3B:
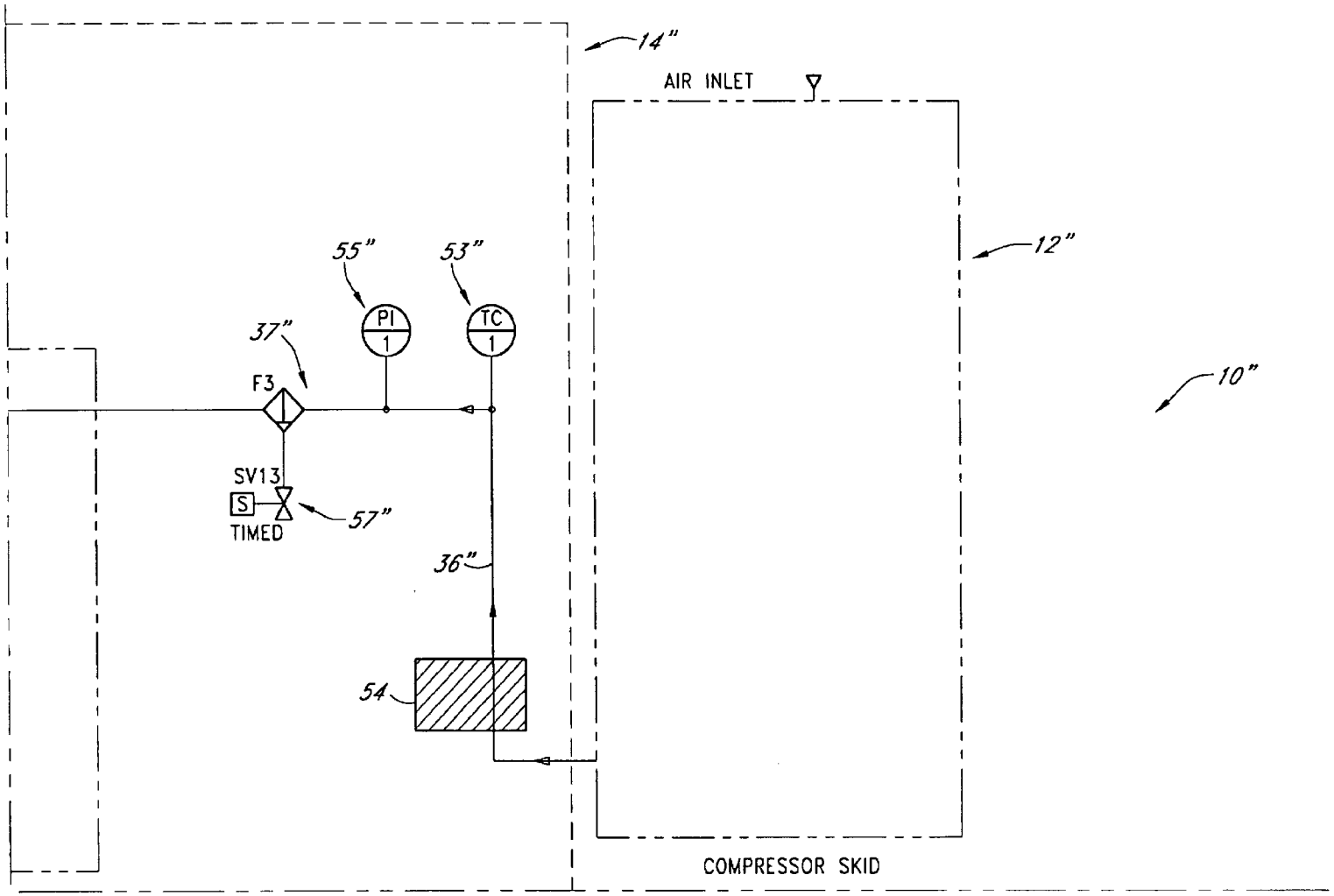
Figure 3C:
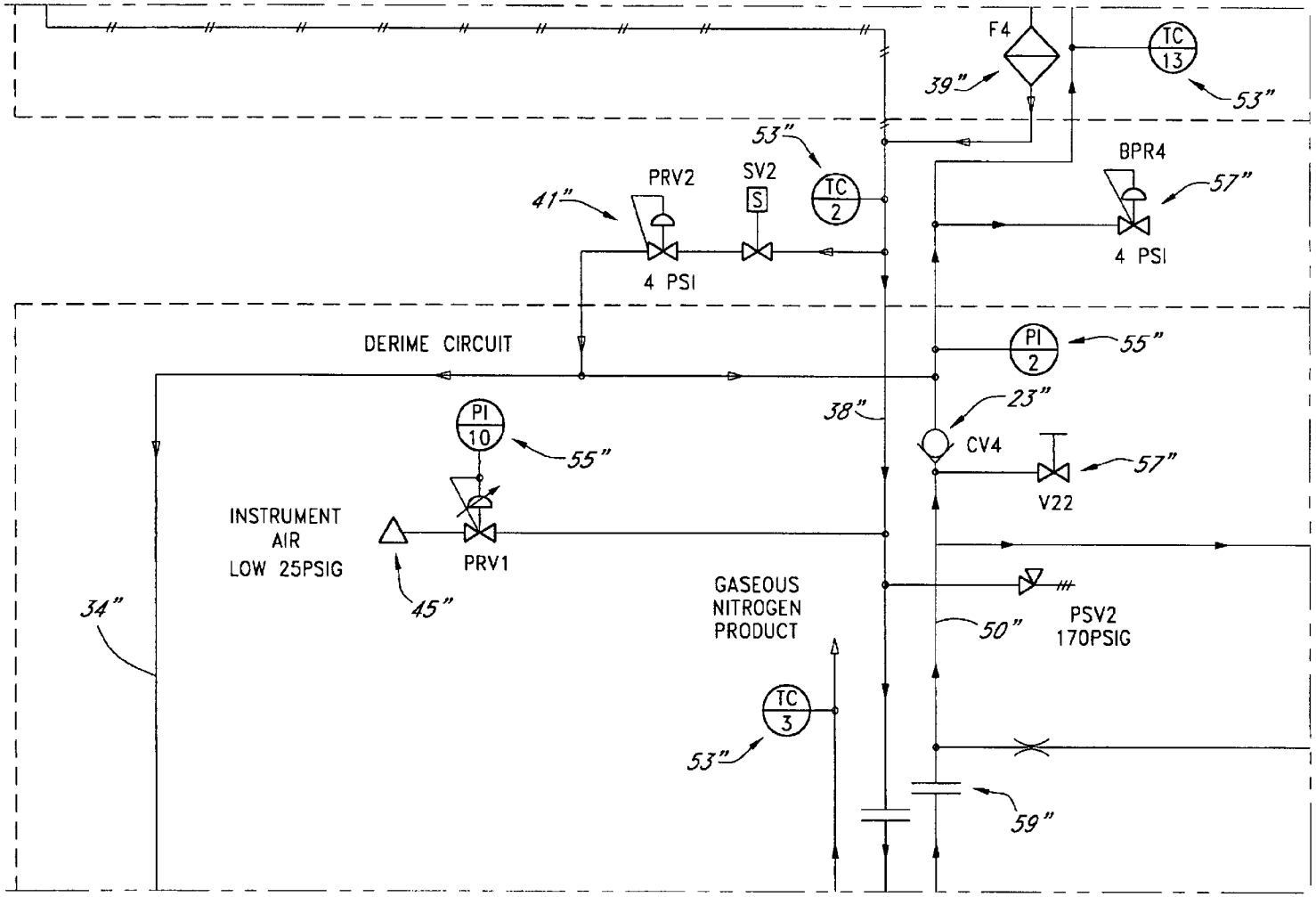
Figure 3D:
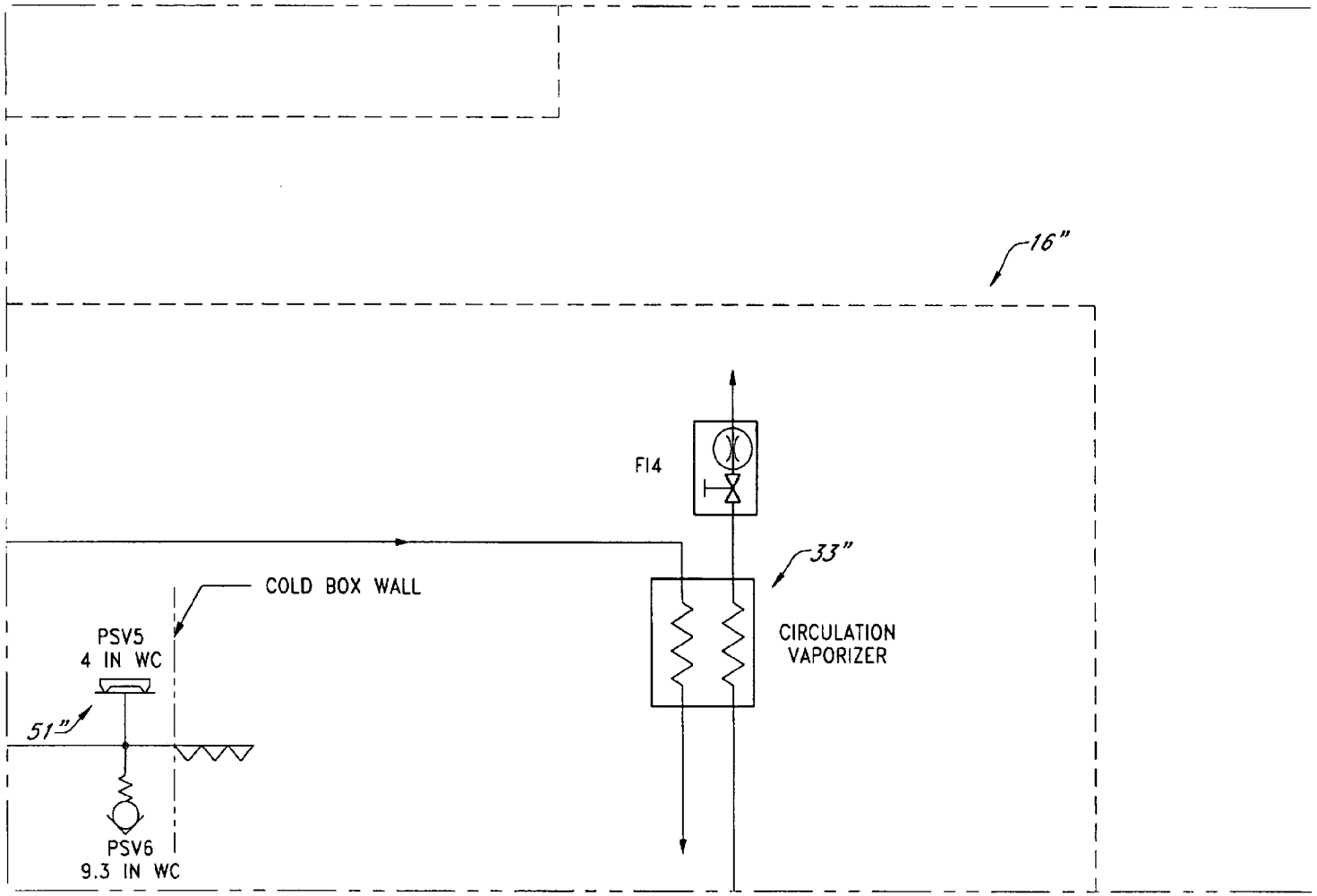
Figure 3E:
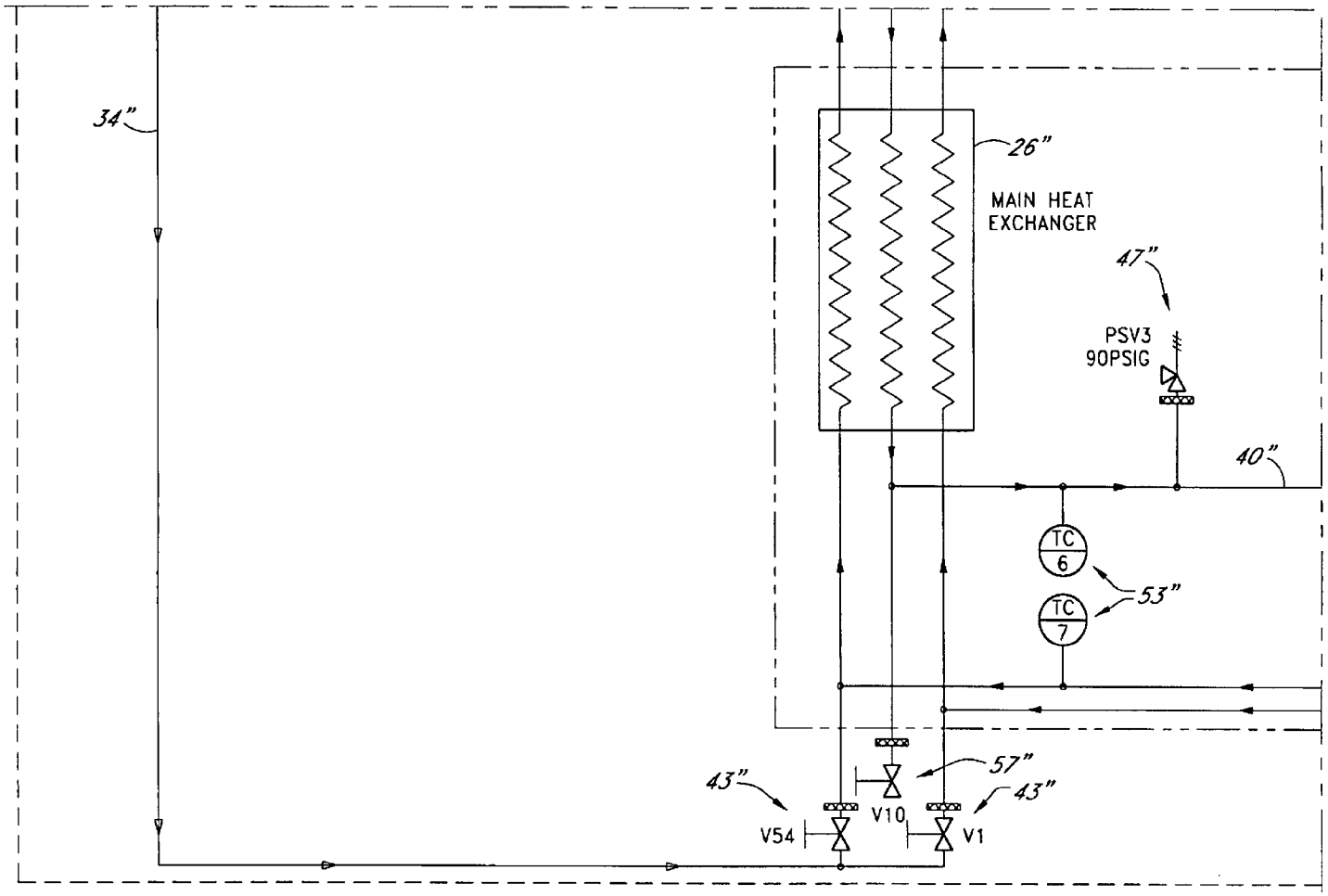
Figure 3F:
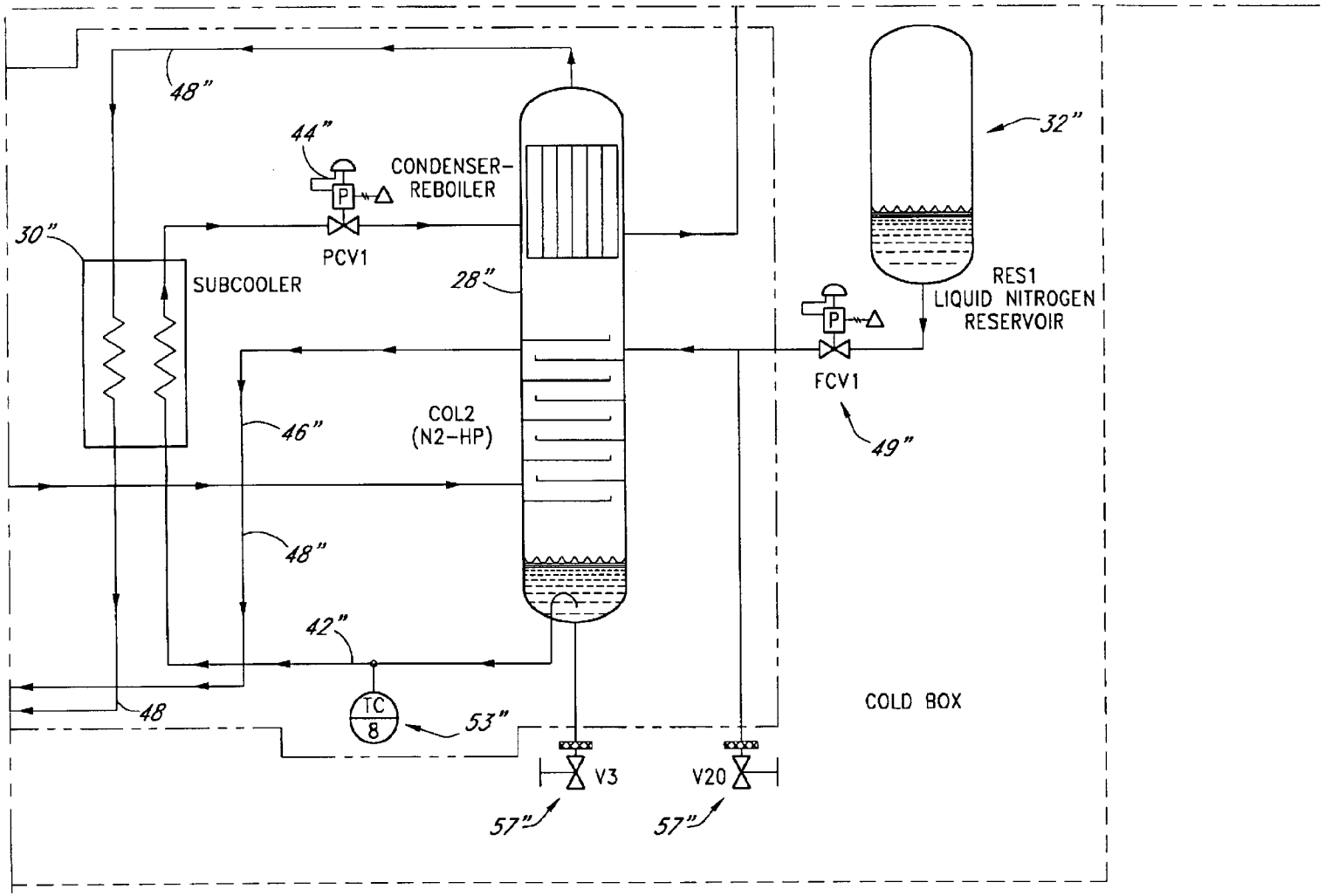

With reference to FIG. 1, a gas separation unit, constructed in accordance with one aspect of the present invention, is illustrated therein identified by the reference numeral 10. The gas separation unit 10 comprises an air source 12, an absorption unit 14, and a cryogenic distillation unit 16.

The air source 12 can be in the form of any source of air. Preferably, the air source 12 is an air compressor configured to pressurize air. Any commercially available air compressor can be used for the air source 12. For example, the air source 12 can be a centrifugal, dry or lubricated screw, or reciprocating-type air compressor. If an oil-lubricated system is used, additional equipment can be used to remove oil droplets and vapors formed during the compression process.

The absorption unit 14 can be in the form of a pressure swing absorption (PSA) or a temperature swing absorption (TSA) system. Preferably, the absorption unit 14 is configured to remove water vapor, carbon dioxide, and other air contaminants from a feed stream of air from the air source 12. The illustrated absorption unit 14 is a pressure swing absorption unit and preferably includes at least two absorption beds 18, 20. In the illustrated embodiment, the absorption unit 14 includes three absorption beds, 18, 20, and 22. The absorption unit 14 also includes a set of check valves 23 disposed downstream of the absorption beds 18, 20, 22 to prevent reverse flow into the absorption beds 18, 20, 22 during operation of the unit 14 and to allow flow into the beds 18, 20, 22 to reactivate the beds 18, 20, 22 by purging, described below. Those of ordinary skill in the art readily appreciate that the check valves can be in the form of passive mechanical check valves, or electronically controlled solenoid or switch controlled valves.

The absorption unit 14 also includes the controller 24. The controller 24 can be in the form of a programmable logic controller configured to emit electronic control signals via a plurality of connectors 25 to a plurality of electronic actuators 27 which control the operation of a plurality of valves 29 which, in turn, control the flow of gases in and out of the beds 18, 20, 22. Alternatively, the controller 24 can be configured to selectively apply pneumatic pressure to a plurality of pneumatic actuators for controlling the valves 29. The operation of the controller 24 and the associated valves 29 is well known in the art and thus will not be described further.

The cryogenic distillation unit 16 includes a main heat exchanger 26, a distillation column 28, and preferably a sub-cooler 30. The illustrated embodiment also includes a coolant reservoir 32, a purge vaporizer 33, and a defrosting circuit 34. The operation of the defrosting circuit 34 is well known in the art, and thus is not described further.

In operation, compressed air is delivered from the air source 12 to the absorption unit 14 through a compressed air conduit 36. A condensate trap 37 is disposed inline with the conduit 36. The trap 37 removes condensed water and oil from the air supplied by the air source 12 before it enters the absorption unit 14. In the absorption unit 14, water vapor, carbon dioxide, and a majority of other air contaminants are removed. As noted above, the illustrated absorption unit is a pressure swing absorption device.

In the illustrated embodiment, the absorption unit can be configured to provide pre-purification of the compressed air from the air source 12. As known in the art, the absorption unit 14, operating under a pressure swing absorption principle, selectively pressurizes and depressurizes the beds 18, 20, 22 through the actuation of the valves 29 which are controlled by the controller 24. Absorbent material in the beds 18, 20, 22 is used to absorb the water vapor, carbon dioxide, and other air contaminants. Once each bed is saturated with the waste products, the bed can be reactivated by purging, described below. The pre-purified air from the absorption unit 14 can be delivered to the cryogenic distillation unit 16 through a conduit 38. Check valves 23 disposed downstream of the absorption beds 18, 20, 22 can prevent reverse flow along the conduit 38 during operation of the absorption unit 14. A particulate filter 39 can be disposed in-line with the conduit 38. The particulate filter 39 prevents dust from the absorption unit 14 from entering the cryogenic distillation unit 16.

The pre-purified and compressed air, which is predominately oxygen and nitrogen, is fed into the main heat exchanger 26. The main heat exchanger 26 is configured to cool the incoming pre-purified air to its condensing temperature. Refrigeration for cooling the incoming pre-purified air is provided by purified nitrogen (i.e., product nitrogen) and waste gas discharged from the distillation unit 16, described in greater detail below. A startup/defrost loop control 41 connects to the conduit 38 upstream of the heat exchanger 26. The loop control 41 diverts a portion of the air stream through the defrosting circuit 34 and associated valves 43 during the initial activation of the absorption unit 14 and for periodic defrosting of the cryogenic distillation unit 16 to remove built-up contaminates. An instrument air supply line 45 can also be connected to the conduit 38 upstream of the heat exchanger 26 and diverts a portion of the pre-purified air stream to supply instrument air to plant controls and instruments.

The cooled pre-purified air discharged from the main heat exchanger 26 is supplied to the distillation column 28 through a conduit 40. A safety valve 47 can be connected to the conduit 40 to provide high-pressure safety relief to the heat exchanger 26 and distillation column 28. The conduit 40 is connected to a lower end of the distillation column 28. As the cooled and pre-purified air enters the distillation column 28, it contacts a descending liquid reflux, described in greater detail below.

As the pre-purified and cooled air rises within the distillation column 28, the nitrogen concentration increases until it reaches the top of the column. Preferably, the pre-purified and cooled air rises through a series of distillation trays or packing material as it rises through the distillation column 28.

Above the distillation trays or packing material, a further heat exchanger, commonly known as a "condenser/reboiler,"

can be disposed within the distillation column. The rising pre-purified and cooled air, which has been distilled into purified or "product nitrogen," rises and thus flows into thermal communication with the reboiler/condenser where it is condensed against a boiling stream of oxygen-enriched reflux, described in greater detail below.

The condensed liquid nitrogen then falls into the distillation column, and in particular through the distillation trays or packing material, and thus effects the desired separation on the rising pre-purified gas. As noted above, the falling condensed nitrogen is referred to as "liquid reflux." As this liquid reflux falls through the distillation column, it causes oxygen to separate out of the rising pre-purified air and thus the liquid reflux itself becomes enriched with oxygen.

At the bottom of the distillation column, the liquid reflux stream, which includes liquid nitrogen enriched with oxygen, pools. The pooled liquid reflux is discharged from the lower end of the distillation column through a conduit 42. The liquid reflux, flowing through the conduit 42, enters an optional subcooler 30. After leaving the subcooler 30, the liquid reflux flows through the pressure reduction valve 44, which lowers pressure and thus lowers the boiling point of the liquid reflux to a temperature lower than the boiling point of the higher pressure nitrogen gas flowing upward toward the top of the distillation column 28. Thus, as the liquid reflux boils, and thus changes phase, it absorbs heat from the higher-pressure nitrogen gas flowing up towards the top of the distillation column 28.

Optionally, a portion of the liquid reflux is diverted to the purge vaporizer 33 to prevent the build up of contaminates. In one embodiment, the vaporizer 33 comprises an external heat exchanger that vaporizes the liquid against compressed air. In another alternative, a portion of the liquid reflux can be mixed with waste stream entering the cold end of the vaporizer.

In order to compensate for process and heat leak refrigeration losses, liquid nitrogen (LIN) from the liquid coolant reservoir 32 is introduced at the top of the distillation column where it is mixed with the reflux stream of oxygen enriched liquid nitrogen flowing downward through the distillation column 28 and is thus used in the distillation process to further aid and separation of oxygen from the rising pre-purified air. A liquid assist control valve 49 is disposed downstream of the reservoir 32 and regulates the flow of liquid nitrogen from the reservoir 32 into the distillation column 28.

The uncondensed gaseous nitrogen at the top of the distillation column is directed to the cold end of the main heat exchanger 26 through a conduit 46. As the uncondensed nitrogen gas passes through the main heat exchanger 26, it absorbs heat from the incoming pre-purified air, as noted above. As the flow of uncondensed nitrogen gas leaves the main heat exchanger 26, it is approximately at ambient temperature. This flow of product nitrogen gas at ambient temperature is delivered to either a generator battery limits or to the suction of a booster compressor where it is raised to the desired delivery pressure. For a drilling operation, the pressure can be raised to from about 70 psig to about 10,000 psig. More typically, the pressure is raised from about 1,000 to 2,000 psig.

With reference again to the reboiler/condenser and the distillation column 28, as the liquid reflux is revaporized, it is discharged from the top of the distillation column 28 through a conduit 48. The conduit 48 directs the vaporized oxygen enriched reflux through the optional subcooler 30. In the subcooler 30, heat from the liquid reflux flowing through the conduit 42 is absorbed by the flow of vaporized reflux flowing through the conduit 48. After the subcooler, the vaporized reflux is directed through the cold end of the main heat exchanger 26.

Within the main heat exchanger 26, the vaporized reflux absorbs additional heat from the incoming flow of pre-purified air. The vaporized reflux from the distillation column 28 can be used for reactivating the beds 18, 20, 22 in the absorption unit 14. Thus, a conduit 50 guides the vaporized reflux back to the absorption unit 14 for purging of the beds 18, 20, 22. The check valves 23 prevent reverse flow along the conduit 50 during the purging process. A cold box purge control 51 connects to the conduit 50 and diverts a portion of the vaporized reflux to maintain a slight positive pressure in the cryogenic distillation unit 16 to prevent moisture laden air from entering the unit 16, where moisture would freeze and air condense upon contact with very cold vessels and/or piping.

Although the various heat exchangers 26, 30, and the condenser/reboiler are illustrated as separate units, all of the heat exchanges in the distillation unit 16, including but not limited to the heat exchangers 26, 30, and the condenser/reboiler, can be constructed as a single unit. Additionally, it is to be noted that the condenser/reboiler can be separate from the distillation unit 28. However, the condenser/reboiler preferably is disposed above the top of the distillation column 28.

The gas separation unit 10 includes a number of thermocouples 53 and pressure sensors 55 for collecting data indications of temperature and pressure, respectively, throughout the system 10. The system 10 also includes a number of drains 57 for draining fluids or purging air out of the system 10 for maintenance or repair purposes.

With reference to FIG. 2, a modification of the separation unit 10 is illustrated therein and identified generally by the reference numeral 10'. Components of the gas separation unit 10' that are similar to the corresponding components of the gas separation unit 10 are identified with the same reference numeral, except that a "'" has been added thereto. These components can be constructed identically to the correspondence components of the gas separation unit 10, except as noted below.

In the gas separation unit 10', a centrifugal expander 52 communicates with the main heat exchanger 26'. The centrifugal expander 52 replaces the addition of liquid coolant from the liquid coolant reservoir 32 of the gas separation unit 10 (FIG. 1). In this modification, the centrifugal expander 52 compensates for process and heat leak refrigeration losses. Optionally, the additional refrigeration provided by the expander 52 can be used to liquefy part of the liquid nitrogen product as liquid or stored for later use, such as, for example, but without limitation, peak operation.

In this modification, the pressure of the oxygen rich reflux vapor discharge from the distillation column 28' is reduced through an expander so as to provide the additional compensating cooling effect. In particular, after the vaporized oxygen rich reflux has entered the cold end of the main heat exchanger 26', the vapor is passed through the centrifugal expander, which reduces the pressure of the reflux vapor and thus the temperature. The expanded oxygen rich reflux is then rerouted through the cool end of the main heat exchanger 26'. As such, the vaporized oxygen rich reflux aids in cooling the incoming pre-purified compressed air. Thus, as noted above, the vaporized oxygen rich reflux can optionally be diverted or stored for any use, or for later use, such as during peak operation.

After passing through the main heat exchanger 26', the vaporized oxygen rich reflux is returned to the absorption unit 14' through the conduit 50'. The expansion of the reflux in the centrifugal expander 52 produces energy. Preferably, the energy, in the form of a spinning shaft, is absorbed through an air or oil brake connected to the shaft of the centrifugal expander 52.

FIG. 3 illustrates a modification of the separation unit 10, and is identified generally by the reference numeral 10". Components of the gas separation unit 10" that are similar to the corresponding components of the gas separation unit 10 are identified with the same reference numeral, except that a "" has been added thereto. These components can be constructed identically to the correspondence components of the gas separation unit 10, and can be used with or without the expander 52, except as noted below.

Preferably, the gas separation unit 10" includes an additional device for removing hydrocarbons. In the illustrated embodiment, the unit 10" includes a catalytic reactor system 54 configured to remove hydrocarbons from the air discharged from the air source 12". An example of such a catalytic reactor system is known as a "Deoxo system."

Preferably, the reactor system 54 is located upstream of the absorption beds 18", 20", 22" and is connected to the air source 12" through the conduit 36". The reactor system 54 preferably includes a housing containing a catalyst. For example, the catalyst can be Platinum or Palladium. The reactor system 54 is configured to receive a stream of air from the air source 12" and an amount of oxygen, and to generate a reaction between the air stream and oxygen to form water and carbon dioxide. The reactor system 54 is further configured to remove the water and carbon dioxide from the air stream.

During operation, a feed stream of air from the air source 12" enters the system 54 through the conduit 36". Inside the system 54, hydrocarbons present in the air stream react with a measured amount of oxygen in the presence of a catalyst to form water and carbon dioxide. The water and carbon dioxide produced by the catalytic reaction are then removed from the air stream by the system 54 and the air stream continues onto the absorption beds 18", 20", 22" essentially free of hydrocarbons. The operation of the system 54 is well known in the art and thus will not be described further.

Figure 4:
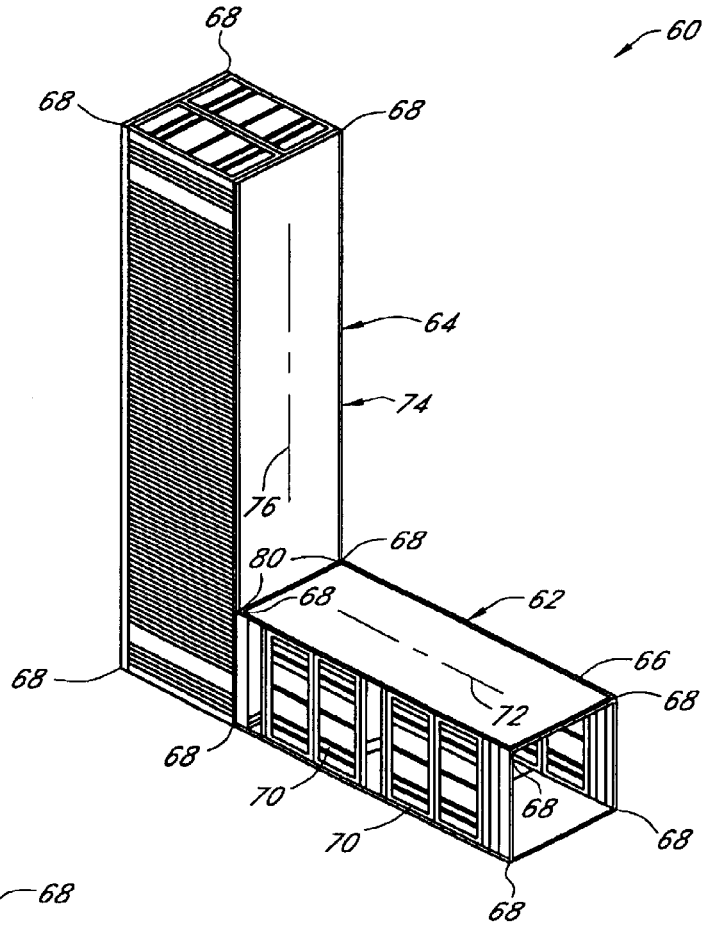
FIG. 4 is a front, top, and left side perspective view of a housing assembly for the gas separation units illustrated in FIGS. 1 and 2, the housing assembly including a generally horizontal portion and a generally vertical portion.

With reference to FIG. 4, a housing assembly 60 is illustrated therein. The housing assembly 60 can be used to house either of the gas separation units 10, 10', 10". Preferably, the housing assembly 60 comprises an air preparation unit housing 62 and a cryogenic distillation and associated heat exchanger housing 64.

Preferably, the air preparation unit housing 62 is comprised of a frame assembly 66 defining a rectangular prism. Additionally, the housing 62 preferably includes anchoring points 68 at each of its corners. Additionally, the housing 62 preferably includes one or a plurality of removable or openable panels 70. For example, the panels 70 can be in the form of hinged doors, panels that are completely removable, scroll-type, or sliding doors.

Preferably, the frame 66 is dimensioned so as to conform to a standard ISO size. For example, the frame 66 can be about five feet, seven feet, ten feet, twenty feet, forty, or forty-five feet long. As used herein, "length," or "long," refers to the longest dimension of the frame 66, i.e., the major axis 72. Additionally, the frame 66 can have a standard height, such as, for example, but without limitation, five feet, seven feet, eight feet, or nine and one-half feet. Additionally, the anchoring points 68 preferably conform to ISO standard anchoring points. Such anchoring points have at least two flat faces, each of which includes an aperture for connection to other anchoring points or other anchoring or connector devices.

The housing 64 includes a frame 74. The frame 74 preferably is configured and sized to conform to at least one standard ISO container dimension. For example, but without limitation, the frame 74 can have a length along its major axis 76 of five feet, six feet, seven feet, ten feet, twenty feet, or forty feet. Additionally, the frame 74 also preferably includes anchoring points 68 at each of its corners.

Figure 4A:
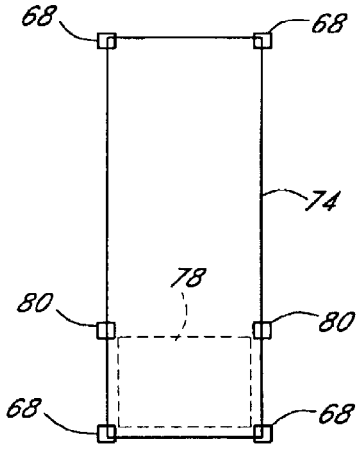
FIG. 4A is a left side elevational view of the generally vertical portion of the housing assembly of FIG. 4.

With reference to FIG. 4A, one side of the housing 64 preferably includes an aperture 78 that can be aligned with an aperture on the housing 62. Preferably, the aperture 78 includes a hinged, removable, scroll-type, or sliding door. Additionally, the frame 74 preferably includes two additional anchoring points 80 that are not positioned at a corner of the frame 74. Rather, the additional mounting points 80 are disposed on a longitudinally-extending side of the frame 74 so as to be in alignment with two of the anchoring points 68 of the frame 66.

For example, as shown in FIG. 4, one end of the housing 62 abuts a lower end of the housing 64. The standard anchoring points 68 on the housing 64 are in alignment with the lower anchoring points 68 of the housing 62. Additionally, the mounting points 80 are in alignment with the upper anchoring points 68 of the housing 62. Thus, when the housings 62, 64 are arranged as illustrated in FIG. 4, the mounting points 68, 80 can be connected together to ensure a secure connection between the housings 62, 64 and thus protect any plumbing connection between the absorption unit 14, 14', 14" and the distillation and heat exchanger unit 16, 16', 16". Additionally, by connecting the housings 62, 64 as such, the housing assembly 60 is more stable and thus less likely to fall over if struck by heavy machinery or exposed to a strong wind.

For example, as shown in FIG. 5, the absorption unit 14, 14', 14" is mounted within the housing 62. Optionally, the compressor 12 can also be mounted in the housing 62. Further, another compressor can be mounted in the housing 62. For example, as noted above with reference to FIG. 1, a booster compressor can be used to raise the pressure of the product Nitrogen. Thus, such a booster can be mounted in the housing 62. Additionally, the cryogenic distillation unit 16, 16', 16" is mounted within the housing 64. Preferably, the absorption unit 14, 14', 14" and cryogenic distillation unit 16, 16', 16" are rigidly mounted to the interior of the housings 62, 64, respectively. Vibration isolation devices can be used for rigidly mounting the units 14, 14', 14", 16, 16', 16" to the housings 62, 64.

As schematically shown in FIG. 1, the conduits 38, 38', 38", and 50, 50', 50" preferably include flanges 59 which allow the conduits 38, 38', 38", 50, 50', 50" to be separated in proximity to the apertures in the housings 62, 64. Preferably, the flanges 59 are located closer to the apertures in the housings 62, 64 than as depicted in FIG. 1. For example, the conduits 38, 38', 38", 50, 50', 50" can include flat flanges disposed in proximity to the apertures in the housings 62, 64. Alternatively, the flanges 59 disposed on the conduits 38, 38', 38", 50, 50', 50" can be disposed so as to be spaced apart when the housings 62, 64 are juxtaposed to each other. In this modification, flexible or rigid intermediate conduits can be installed between the flanges so as to complete the conduits 38, 38', 38", 50, 50', 50".

With reference to FIG. 6, a modification of the housing assembly 60 is illustrated therein and identified generally by the reference numeral 60A. Components of the housing assembly 60A similar to corresponding components of the housing assembly 60 are identified with the same reference numeral, except that a letter "A" has been added.

As shown in FIG. 6, the lower portion of the housing 64A is aligned with a central portion of the side of the housing 62A. Preferably, in this modification, as shown in FIG. 6A, the frame 66A of the housing 62A includes additional anchoring points 80 on the side of the housing 62A that faces the housing 64A. The additional anchoring points 80 disposed on the frame 66A can be connected to the anchoring points 68A, 80A of the housing 64A.

By connecting the housing 64A to a central side portion of the housing 62A, the housing assembly 60A provides further stability and thus better protection against the risk of tip over of the housing 64A.

Figure 7:
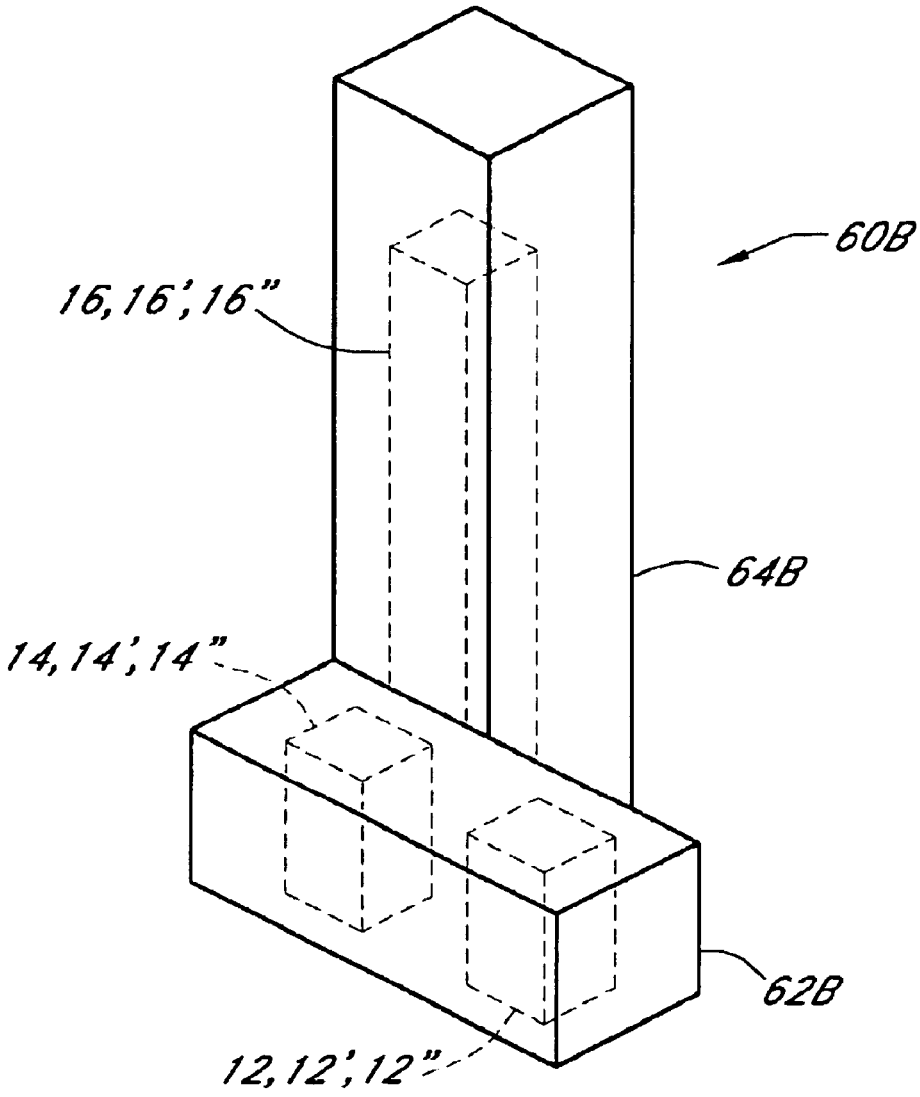
FIG. 7 is a front, top, and left side perspective view of a further modification of the housing assembly illustrated in FIG. 5.

With reference to FIG. 7, a further modification of the housing assembly 60 is illustrated therein and identified generally by the reference numeral 60B. Components of the housing assembly 60B similar to the corresponding components of the housing assemblies 60, 60A are identified with the same reference numeral, except that a letter "B" has been added.

As shown in FIG. 7, the housing 64B can be connected to a side of the housing 62B adjacent a longitudinal end thereof. The connections between the housing 62B and 64B of the assembly 60B can be the same as those described above with reference to FIG. 5.

As noted above, by mounting an absorption unit in one container having standard ISO container dimensions and mounting a cryogenic distillation unit in a second container also including standard ISO container dimensions, an entire cryogenic gas separation unit can be conveniently shipped to a drilling location and quickly assembled. Additionally, because the units 14, 14', 14", 16, 16', 16" remain in the containers, they are well protected from hazards common at the site of a drilling operation.

Additionally, by connecting the housings 62, 62A, 62B, 64, 64A, 64B together using the standard ISO anchoring point hardware, the entire housing assembly 60, 60A, 60B can be stabilized. This is particularly advantageous because the containers or housings 64, 64A, 64B which house the cryogenic distillation units, stand on their longitudinal end in operation. Thus, connecting the housing together provides additional stability thereby lowering the risk that the housing 64, 64A, 64B could tip over. Preferably, the housings 62, 62A, 62B are preferably connected to the housings 64, 64A, 64B with bridge fittings which provide a tension and can connect the containers so they touch each other.

While a cryogenic process to produce Nitrogen from ambient air is disclosed herein, other similar cryogenic processes can be used to produce the desired product Nitrogen. In the systems described above, refrigeration is generated by either the injection of liquid Nitrogen or by the expansion of waste gas from the distillation process to compensate for heat leak and process losses.

Other cryogenic processes can include the expansion of part or all of the inlet air to produce the required refrigeration. Such processes, including the processes disclosed above, are considered to be applicable to the present inventions.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of the present inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above, but should be determined only by a fair reading of the claims that follow.

What is claimed is:

1. A gas separation device comprising a first container defining a first major axis and comprising a frame, an absorber assembly mounted in the first container so as to be surrounded by the frame, a second container defining a second major axis and comprising a second frame, a cryogenic distillation device mounted in the second container so as to be surrounded by the frame, the first and second containers including first and second apertures, respectively, the absorber assembly and the cryogenic distillation device being configured to be connected through the first and second apertures and operate while being mounted in the first and second containers, wherein each of the first and second containers includes at least four anchoring points, the anchoring points being arranged such that at least four of the anchoring points on the first container are aligned with at least four of the anchoring points on the second container when the first and second containers abut each other with the respective major axes extending perpendicularly to each other, the at least four anchoring points extending around the periphery of the first and second apertures.

2. The separation device according to claim 1, wherein the first and second frames are configured to conform to at least one standard ISO container size.

3. The separation device according to claim 2, wherein the second container is about 40 feet long.

4. The separation device according to claim 1, wherein the anchoring points are arranged such that four anchoring points on each of the first and second containers can be connected to each other when the major axis of the first container extends generally horizontally and the major axis of the second container extends generally vertically.

5. The separation device according to claim 1, wherein the absorption assembly includes at least a first pipe terminating adjacent the first aperture, and the cryogenic distillation assembly includes at least a second pipe terminating adjacent the second aperture.

6. The separation device according to claim 5, wherein the terminal ends of the first and second pipes can be connected together when the first and second apertures are juxtaposed to each other.

7. The separation device according to claim 1 additionally comprising a drilling rig, an output of the separation device being connected to the drilling rig.

8. The separation device according to claim 1, wherein the absorption device and the cryogenic distillation device are configured to separate nitrogen gas from atmospheric air.

9. A nitrogen gas generator configured to produce gas comprising more than 95 percent nitrogen through separation of the nitrogen from atmospheric air, the generator comprising an absorption unit, a cryogenic distillation unit, a first shipping container having a first aperture and being configured to conform to a standard ISO container size, the absorption unit being rigidly affixed to an interior of the first shipping container, a second shipping container having a second aperture and being configured to conform to at least one standard ISO container size, the cryogenic distillation unit being rigidly affixed to an interior of the second shipping container, the absorption unit and the cryogenic distillation unit being configured to be connected through at least one pipe while remaining rigidly affixed to the respective containers during operation, wherein each of the first and second containers comprises a plurality of anchoring points extending around the periphery of the first and second apertures, respectively, and wherein the anchoring points are configured to allow the first and second containers to be connected to each other such that the first container extends generally horizontally, and the second container extends generally vertically.

10. The generator according to claim 9 additionally comprising an air compressor rigidly affixed to the interior of the first shipping container.

11. The generator according to claim 9, wherein the first and second shipping containers include first and second apertures, respectively, and wherein the at least one pipe connects the absorption unit and the cryogenic distillation unit through the first and second apertures.

12. The generator according to claim 9, wherein the second container is about 40 feet long.

13. The generator according to claim 9, wherein the absorption unit is configured to separate at least carbon dioxide and water vapor from compressed air, thereby producing pre-purified air, the cryogenic distillation unit being configured to separate oxygen from the pre-purified air, thereby producing the gas containing more than 99 percent nitrogen gas.

14. The generator according to claim 9, wherein a gas output of the generator is connected to a drilling rig.

15. The generator according to claim 14, wherein the drilling rig is configured to drill a well into the earth.

16. The generator according to claim 15, wherein the absorption unit and the cryogenic distillation unit are configured to supply a flow rate of the gas containing more than 99 percent nitrogen, sufficient for moving drill cuttings upwardly from a downhole region of a well.

17. The generator according to claim 11, wherein the first and second shipping containers include third and fourth apertures, respectively, each of the third and fourth apertures including at least one panel movable between open and closed positions.

* * * * *